United States Patent [19]

Lynch et al.

[11] Patent Number: 5,023,643

[45] Date of Patent: Jun. 11, 1991

[54] AUTOMATIC PHOTO PROCESSOR

[75] Inventors: Marine D. Lynch, Beaverton; James W. Bernklau, Tigard; Richard D. Paulson, Beaverton; Steven L. Reeck, Portland, all of Oreg.

[73] Assignee: Wing-Lynch, Inc.

[21] Appl. No.: 482,009

[22] Filed: Feb. 15, 1990

[51] Int. Cl.[5] ..... G03D 3/04; G03D 3/06

[52] U.S. Cl. ..... 354/299; 354/323; 354/324; 354/330

[58] Field of Search ..... 354/299, 323, 324, 329, 354/330

[56] References Cited

U.S. PATENT DOCUMENTS

| | | | |
|---|---|---|---|
| 3,695,162 | 10/1972 | Wing . | |
| 3,828,172 | 8/1974 | Schickler . | |
| 3,846,818 | 11/1974 | Merz . | |
| 4,035,818 | 7/1977 | King . | |
| 4,206,993 | 6/1980 | Csepke . | |
| 4,269,501 | 5/1981 | Griffith et al. . | |
| 4,708,451 | 11/1987 | Wing et al. . | |
| 4,888,607 | 12/1989 | Stutz et al. | 354/323 |

*Primary Examiner*—A. A. Mathews

*Attorney, Agent, or Firm*—Kolisch, Hartwell, Dickinson, McCormack & Heuser

[57] ABSTRACT

A photo processor is intended for use with a water source and a liquid disposal system and includes plural solution storage tanks and an elongate processing trough. A liquid-entry manifold is located intermediate the ends of the processing trough adjacent the center thereof and is used to introduce processing solutions and water into the trough. A mechanism is provided for maintaining the photographic material in the central portion of the trough adjacent the liquid-entry manifold. Plural, substantially simultaneously acting exhaust drains are provided for exhausting a liquid from the trough. A liquid delivery system delivers processing solutions from the storage tanks from the trough and also delivers wash water into the trough. A control system is provided to control processor operation and includes a mechanism for adjusting processing time in selected processing steps as a function of the temperature of the processing solution.

42 Claims, 14 Drawing Sheets

CONTROLLER
12 VOLTS D.C.
BACK-UP BATTERY 12 VDC
TEMPERATURE CONTROLLED WATER
DRAIN
ALARM ENUN-CIATOR
SIGNAL CONDITIONER
$N_2$ SOURCE
LOW PRES. REG.
DRAIN
RECOVERY SYSTEM
PRESSURE REG. COLD WATER
12 VOLTS D.C.
HEATER SUPPLY
POWER SUPPLY
10
22
25
26
27
28
40
42
44
46
47
48
50
52
54
56
58
58a
60
62
64
66
68
70
72
74
76
78
80
82
84
88
90
92
94
96
124
136
138
140
142
146
148
150
152
154
156
164
165
166
168
170
172
174
176
178
180
182
24
226a

FIG. 5
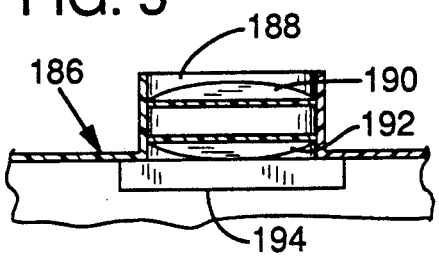
FIG. 4
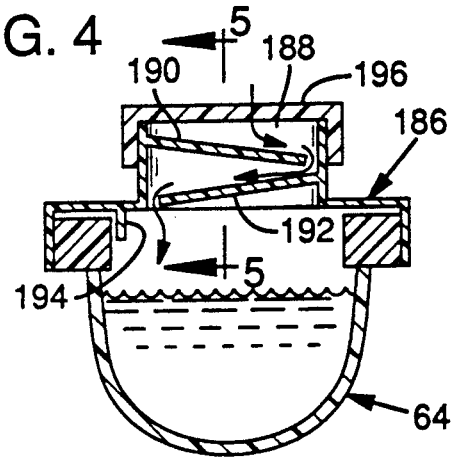
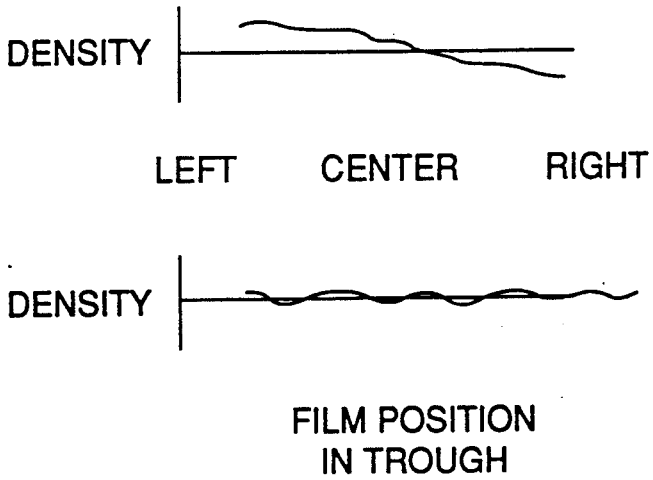
FIG. 6a
FIG. 6b
FIG. 6

AUTOMATIC PHOTO PROCESSOR

BACKGROUND OF THE INVENTION

The instant invention relates to photo processing machines, and specifically to a photo processing machine which is designed for high quality commercial photographic processing of photographic material.

A number of rotary tube photographic processing machines are known. One such machine is disclosed in U.S. Pat. No. 3,695,162 to Wing, for DEVELOPING MACHINE FOR PHOTOGRAPHIC FILM, issued Oct. 3, 1972. Another known processor is disclosed in U.S. Pat. No. 4,035,818 to King, for COLOR PRINT OR FILM PROCESSOR. While the known machines are suitable for their intended purpose, the processing of modern photographic film and paper requires much finer temperature and time control for film and paper processing than is possible with the existing devices. As the number of film types increase, and developing times decrease, it is necessary to quickly introduce into, and expel processing solutions from, the container holding the sensitized photographic material which is being processed. Failure to switch processing solutions quickly will result in non-uniform density among, for instance, the several rolls of film being simultaneously processed in the processor.

Film, for instance, is usually processed by placing a roll of film onto a spiral metal reel and placing one or more reels into a container which is constructed to allow the entry of processing solutions thereunto. The container is held, in a horizontal manner, in an elongate trough and rotated while various processing solutions are introduced into the trough and expelled, or allowed to drain therefrom.

SUMMARY OF THE INVENTION

An object of the invention is to provide a photo processor which processes multiple pieces of sensitized photographic material and which results in uniform photographic density in the finished product.

Another object of the invention is to provide a photo processor which is capable of processing a variety of photographic material types under substantially automated control.

Another object of the invention is to provide a photographic processor which allows for rapid introduction of and expulsion of processing solutions from a processing trough.

A further object of the invention is to provide a photographic processor which provides storage for photo processing solutions in a substantially non-oxidizing atmosphere.

Another object of the invention is to provide a photographic processor which will minimize sensitometric deviations in the processed material.

Still another object of the invention is to provide a photo processing machine which will automatically process a variety of photographic material types.

Yet another object of the invention is to provide a photo processing machine which automatically compensates for processing solution temperature variations above or below a predetermined value.

Another object of the invention is to provide a photographic processing machine which maintains photographic processing solutions at a predetermined temperature.

The photo processor of the invention is intended for use with a water source and a liquid disposal system and includes plural solution storage tanks and an elongate processing trough. A liquid-entry manifold is located intermediate the ends of the processing trough adjacent the center thereof and is used to introduce processing solutions and water into the trough. A mechanism is provided for maintaining the photographic material in the central portion of the trough adjacent the liquid-entry manifold. Plural, substantially simultaneously acting exhaust drains are provided for exhausting a liquid from the trough. A liquid delivery system delivers processing solutions from the storage tanks to the trough and also delivers wash water into the trough. A control system is provided to control processor operation and particularly to adjust process step times as a function of the processing solution temperature.

These and other objects and advantages of the invention will become more fully apparent as the description which follows is read in conjunction with the drawings.

BRIEF DESCRIPTION OF THE DRAWINGS

FIG. 4 is a medial section of a manual-filling trough cover of the invention.

FIG. 5 is a front sectional elevation of the manual-filling cover, taken generally along the line 5—5 of FIG. 4.

FIG. 6 is a representation of processed film density, with FIG. 6*a* representing film density as achieved by a prior art processor, and FIG. 6*b* representing that achieved by the processor of the invention.

DETAILED DESCRIPTION OF THE PREFERRED EMBODIMENT

Figure 1:
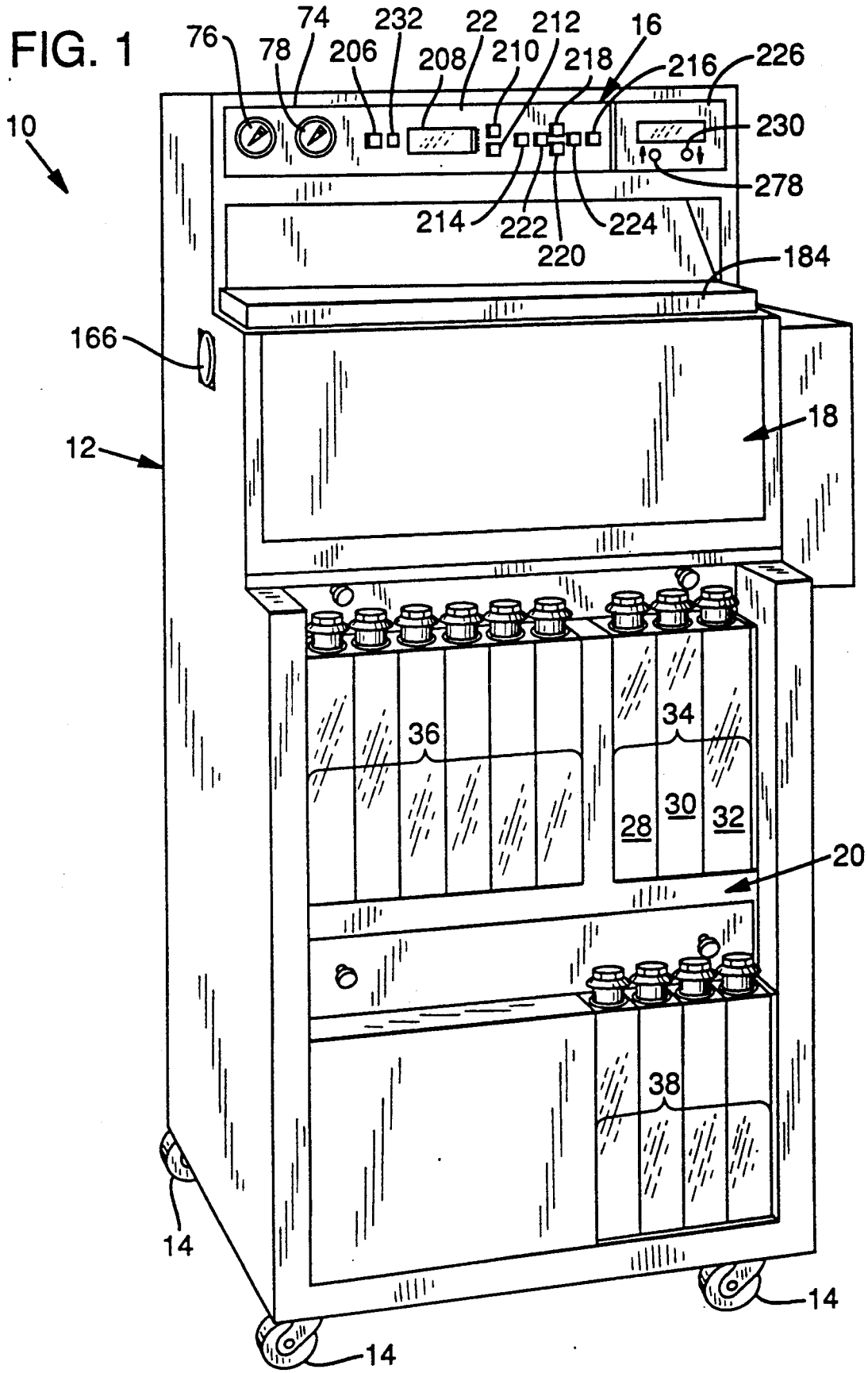
FIG. 1 is a perspective view of a photo processing machine constructed according to the invention.

Referring now to the drawings, and initially to FIG. 1, a photographic processing machine constructed according to the invention is shown generally at 10. Processor 10 includes a cabinet 12 which is mounted on casters 14 to provide easy movement of the processor. The processor includes a control panel 16, a processing trough region 18 and a processing solution storage region 20.

Figure 2:
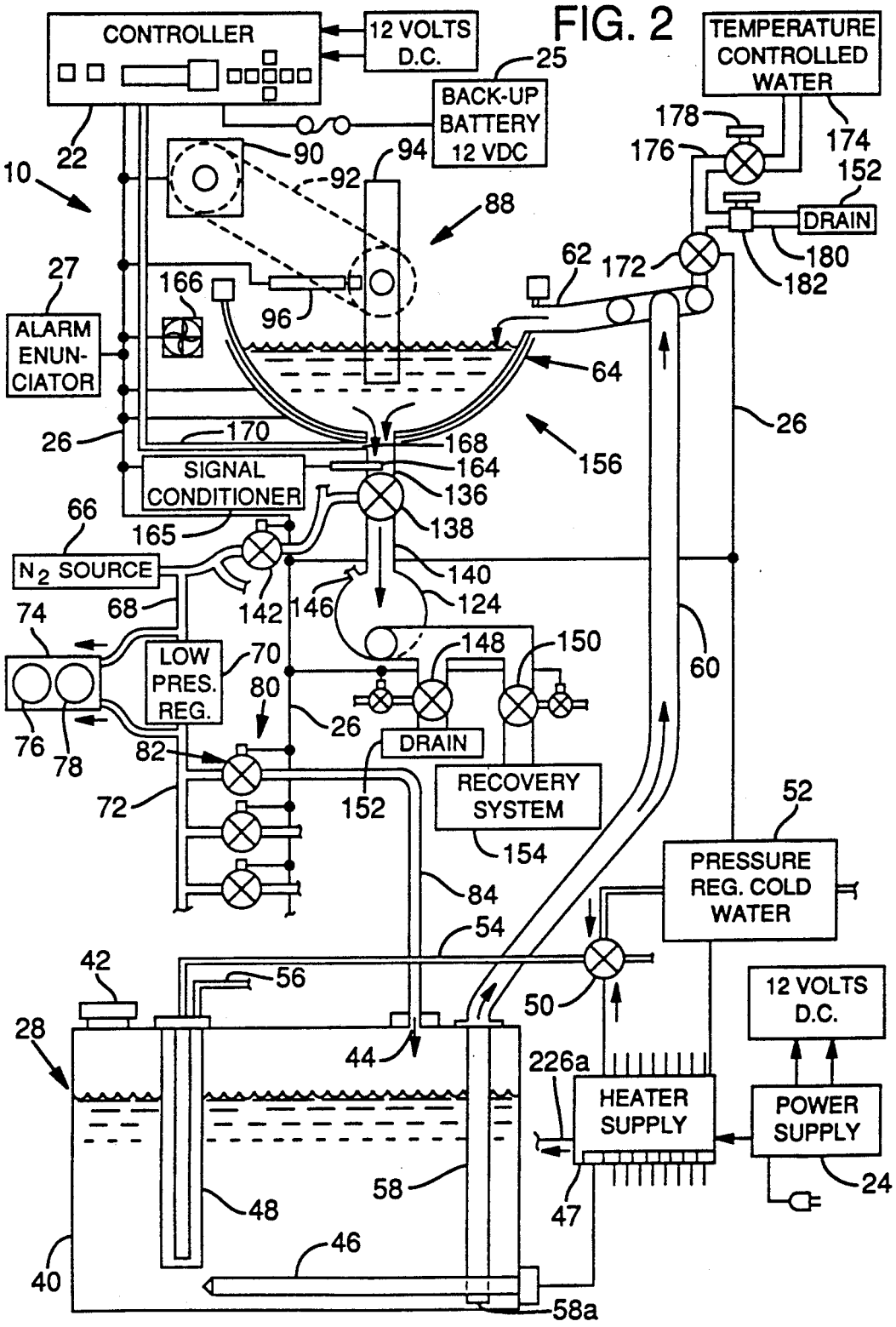
FIG. 2 is a schematic, diagrammatic representation of the processing machine, including fluid delivery and electrical systems.
Figure 3:
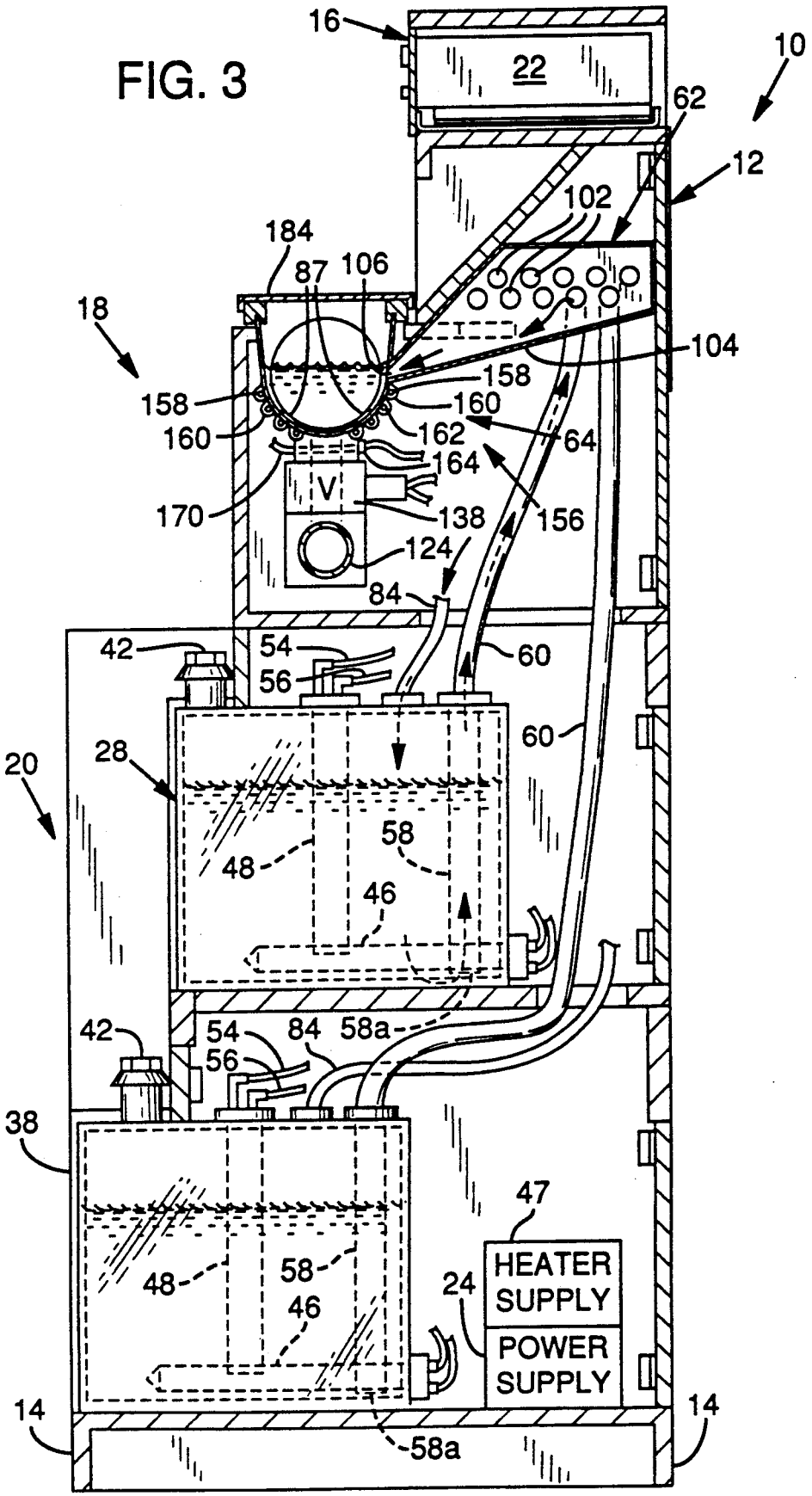
FIG. 3 is a medial section view of the processing machine of FIG. 1, with portions broken away to shown detail.

Referring now to FIGS. 1–3, additional components of processor 10 will be described. A controller, or control system 22, is provided and is located in control panel 16. Controller 22 is powered by a power supply 24, which produces a 12 volt d.c. output. A back-up 12 volt d.c. battery 25 is provided to maintain the general operations of processor 10 in the event of a power failure. Data signals are received by controller 22, and instruction signals passed to the components of the processor, over a controller bus 26. An alarm enunciator 27 is provided to alert the operator of various processor functions or malfunctions.

Although the processor and processing steps are described herein with respect to film processing, it should be understood that the processor may be configured to process prints by providing the proper processing solutions in the tanks in storage region 20 and providing the proper processing information to controller 22.

The processor is perhaps best explained by initially describing the processing solution storage region 20 of the invention. A number of photo processing solutions are stored in individual storage tanks, such as storage tanks 28, 30 and 32. It should be noted that storage region 20 is divided into a number of subregions, such as subregion 34, which contains tanks 28, 30 and 32; subregion 36 and subregion 38. The subregions contain tanks which hold solution for carrying out a particular type of process. For instance, the three tanks in subregion 34 may be used to store developer, bleach, and fixer for a color print film processing regimen, such as that known as C-41. Subregion 36 is suitable for storing the photographic solutions which are used in an E-6 process for developing color reversal film, while the tanks in subregion 38 are suitable for storing three different types of black and white developer and a fixing solution. Additionally, more tanks could be provided in the area to the left of subregion 38, as depicted in FIG. 1.

Referring now to FIGS. 2 and 3, a storage tank, such as storage tank 28 is depicted. All of the storage tanks are similarly constructed, each tank including a cell 40 which has a gas-tight wall surrounding it. In the preferred embodiment, an array of tanks, such as those depicted in subregions 34 and 38, may be constructed with common interior walls and continuous top, bottom, front and rear walls. Although, in the preferred embodiment, each tank has a capacity of approximately one U.S. gallon, processor 10 may be provided with 5 gallon tanks in region 20. Additionally, standalone modules may be provided which may contain solution storage tanks of any size and numbers. Each tank includes a gas-tight cap 42, and a gas inlet port 44 located in the top wall for allowing the entry of a pressurized gas into the cell.

In the preferred embodiment, a storage tank temperature system includes a combined temperature sensor/-heater probe 46 to both sense and heat the processing solution contained in the tank. The probe is connected to a heater supply 47 which monitors the temperature of the solution in each storage tank and, if a temperature that is too low is detected, supply 47 applies power to probe 46, thereby heating the probe and raising the temperature of the solution of the tank. In the preferred embodiment of probe 46, a linear temperature sensor is located at the tip thereof while resistance heating wires are contained along the length thereof.

A coaxial heat exchanger 48 may be provided in each tank and, should heater supply 47, which serves as a separate control mechanism for the storage tank temperature system, detect a solution temperature which is too warm, a valve 50 is opened, allowing cold water from a pressure regulated cold water supply 52 to flow throug a line 54 to coaxial heat exchanger 48, thereby cooling the solution in the tank. Water leaves heat exchanger 48 through a disposal line 56, which may proceed directly to a drain, or may be connected in series to other coaxial heat exchangers.

Each tank includes a draw tube 58 which, in the preferred embodiment, is secured to the top wall of cell 40 which extends substantially to the base or bottom of the cell, where it terminated in a draw orifice **58*a*. Orifice 58*a* may be cut on a diagonal to proved easier flow of solution into tube 58. The tube is positioned so that only a few ounces of solution will remain in the tank as unusable material. Draw tube 58 is connected to a conduit 60, which provides a path for processing solution to travel upwards in the machine towards a liquid-entry manifold 62, which in turn connects to a processing trough 64. Solution is forced through draw tube 58 and conduit 60 by the application of gas pressure which enters the tank through gas inlet port 44**.

In the preferred embodiment, gas pressure is provided from an inert gas supply, such as a nitrogen source 66. Nitrogen source 66 is connected to a high pressure conduit system 68, a low pressure regulator 70 and a low pressure conduit system 72. A pair of gauges 74 are located in control panel 16 and include a high pressure gauge 76 and a low pressure gauge 78.

An array 80 of pneumatic valves is connected to low pressure conduit system 72. Each valve in the array, such as valve 82, is connected by a conduit 84 to gas inlet port 44 of storage tank 28. Upon an appropriate signal, received over controller bus 26, valve 82 opens, allowing nitrogen to enter tank 28, thereby forcing solution from the tank through draw tube 58, conduit 60 into liquid-entry manifold 62 and then into processing trough 64. Processing solutions are pumped from the storage tanks to the trough at a rate of approximately 4 gallons/minute, with a maximum pumped volume of 60 ounces. The length of time that valve 82 is open determines the amount of solution that will be pumped from the storage tank from the processing trough. An added advantage of pumping processing solutions with an inert gas is that the inert gas will retard oxidation of the processing solution contained in the tank. Nitrogen is the preferred inert gas due to its abundant supply and ready availability. In the course of filling the storage tanks, the tanks are filled to a maximum fill line, and the air in the tank is purged by the operator and replaced with nitrogen. The residual gas in the tank then, after the initial processing run is inert, thus prolonging the working life of the solution in the tank.

Figure 7:
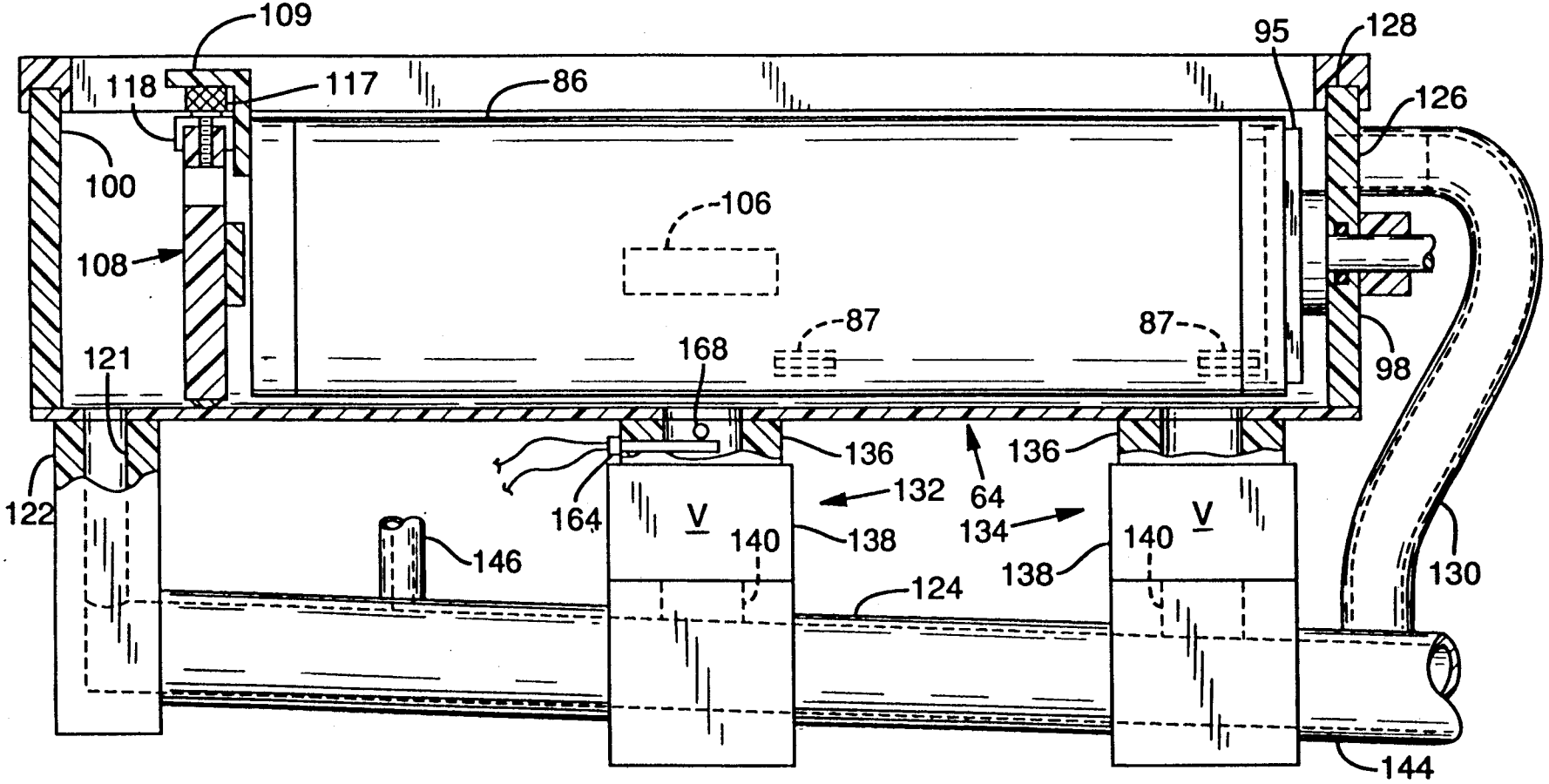
FIG. 7 is a front sectional elevation of a processing trough of the invention, with portions broken away to show detail.

Referring now to FIGS. 2, 3 and 7 the processing trough of the invention will be described in greater detail. Trough 64 is formed as an elongate, substantially half-cylinder from thin wall polymer material. It should be understood that the photographic material which is processed in processor 10 is loaded into a suitable container, such as container 86. Each container has an elongate cylindrical form, is formed of polymer material, and has plural slots and/or bores in the side walls thereof to allow the entry of fluid. In some embodiments, multiple containers may be joined together to form a longer container. The container is suitable for receiving multiple rolls of film which are loaded on spiral film reels. Container 86 is maintained a small distance from the inner surface of trough 64 by spacers 87, which are arranged in trough 64 and located on either side of the longitudinal center line thereof.

Processor 10 includes a drive mechanism, depicted generally at 88, which is provided to rotate the photographic material when such is received in processing trough 64. In the preferred embodiment, drive mechanism 88 includes a reversible motor 90 which is connected by a drive belt 92 to a container-engaging clutch, or drive bar, 94. Container 86 includes a drive hub 95 secured to one end thereof. Drive bar 94 and drive hub 95 are constructed so that they will engage one another such that when drive bar 94 is rotated, it will rotate container 86 with it.

A clutch position sensor 96 is provided to detect the relative position of container engaging drive bar 94 to allow controller 22 to stop operation of motor 90 and thus drive bar 94 at a desired drive bar orientation. This feature is provided to allow easy insertion and removal of container 86 in trough 64. Clutch position sensor 96 is connected to controller bus 26, as is motor 90. Processing trough 64 is an elongate structure which has drive bar 94 located at one end 98 thereof and which has another end 100.

As previously noted, an object of the invention is to provide uniform density in the processing of multiple pieces of photographic material, such as rolls of film. In order to provide uniform density, the rapid introduction of processing solution into trough 64, coupled with the rapid drainage or expulsion of solution from the trough at the end of a particular processing step cycle is required. To this end, liquid-entry manifold 62 is located intermediate the ends of the trough, adjacent the center thereof, for introducing processing solutions and water, which are collectively referred to herein as liquids, into the trough. Referring momentarily to FIG. 3, manifold 62 is depicted and includes a series of ports 102 which are connected to various conduits 60 leading from the processing solutions storage tanks. As solution is pumped from the tanks into the manifold, the solutions run down the bottom 104 of the manifold through a liquid entry port 106 into trough 64. Ports 102 are formed with compound angles to optimize the drainage of solutions back through conduit 60 into the storage tank, and from port 102 into manifold 62, at the end of a pumping step. This construction prevents the retention of residual chemistry in conduit 60, port 102 and manifold 62. Because liquid-entry port 106 is located at the center of trough 64, the liquids introduced into the trough through port 106 are uniformly dispersed to either end of the trough processing region, which is defined by the trough one end 98 and a moveable primary trough dam 108, which is located adjacent the other end of the trough. Container 86 and trough dam 108 comprise what is referred to herein as means for maintaining the photographic material substantially in the central portion of the trough adjacent the liquid-entry manifold. A spacer 109 is placed over primary dam 108 to separate container 86 from the primary dam.

Figure 9:
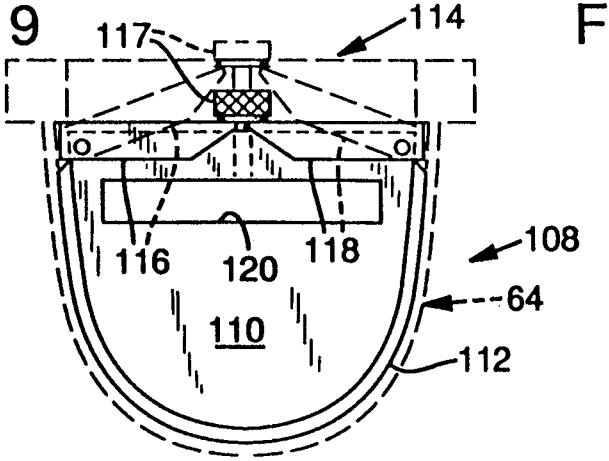
FIG. 9 is a side elevation of a primary trough dam constructed according to the insert.

Referring now to FIG. 9, primary dam 108 is shown in greater detail. Dam 108 includes a dam body 110 which is surrounded by a sealing gasket 112 about the edge thereof. Body 110 and gasket 112 are constructed and arranged to provide a sealing relationship with the inner surface of trough 64. A locking mechanism 114 includes a pair of arms 116, 118 which, when brought down to the upper surface of body 110, and held in place by screw 117, grasp the inner surface of the trough, thereby holding the trough dam in place. Body 110, in the preferred embodiment, includes an overflow port 120 which is provided to allow liquid to escape the trough processing region during some wash steps or in the event that the amount of liquid in the processing region exceed a predetermined volume.

Returning now to FIG. 7, various means for evacuating fluid from trough 64 will be discussed. The first drain mechanism is an overflow system which includes an overflow drain 121 at the bottom of trough 64 adjacent the other (left) end thereof and a conduit 122 connected to drain 121. Conduit 122 connects to an exhaust manifold 124. Trough 64 also includes an overflow port 126 located in the vertical wall 128 at the one (right) end of the trough. A conduit 130 extends between overflow port 126 and exhaust manifold 124. The provision of overflow drains 121 and 126 and their respective conduits, provide a safety feature that prevents excess liquid from accumulating in trough 64. Alternately, conduits 122 and 130 may empty into a second exhaust manifold (not shown).

Processor 10 includes plural, substantially simultaneously acting exhaust drains 132, 134 for exhausting liquid from trough 64. The exhaust drains are substantially similar to one another, however, central exhaust drain 132 has sensors located therein, which will be discussed later. Each exhaust drain includes a conduit 136 which extends downward from trough 64, a pneumatically operated valve 138 and a second conduit 140 which is connected to exhaust manifold 124, referring momentarily to FIG. 2, a single pneumatic valve 142 is connected to high pressure conduit system 68 and then to pneumatic valves 138 in drains 132, 134. Upon an appropriate signal received over controller bus 26, valve 142 opens, thereby causing valves 138 to open, rapidly draining liquid from trough 64 into exhaust manifold 124.

Because the entry of fluid into exhaust manifold 124 is quite rapid, the manifold is sized to be capable of containing the largest amount of fluid which would be expected in processor trough 64 at any one time.

A drain conduit 144 is connected to one end of exhaust manifold 124 for carrying away used fluids. An air vent 146 is provided in exhaust manifold 124 to prevent fluid blockage in the exhaust manifold. Drain conduit 144 extends from exhaust manifold 124 to valves 148 and 150. Under most circumstances, valve 150 is closed and valve 148 is open, allowing fluid contained in the exhaust manifold to enter a drain or disposal system 152. In the case of some solutions, such as the bleaching solutions used in color processing and the fixing solutions used in both color and black and white processing, it is desireable to recover these solutions for reuse or for further processing. A recovery system 154 is provided to retain solutions for further use or processing. As such solutions are drained from the trough, valve 148 is closed while valve 150 is open. Additional valves (not shown) may be provided to direct the solution to any one of a number of recovery tanks which will hold used solution. Valves 148, 150 may be operated either electrically or pneumatically. Signals from controller 22 are used to properly sequence control signals to the valves.

Trough 64 is oriented in a substantially horizontal position, but may have a slight tilt from horizontal to promote rapid expulsion of fluid from the trough and to minimize liquid carryover from processing step to processing step. One form of tilting may simply have one end of the trough lower than the other, while another configuration may have a low center portion, as in a dihedral configuration. Whichever arrangement is used, the trough is arranged to tilt towards one of the exhaust valves.

Returning now to FIGS. 2 and 3, a trough temperature maintenance system 156, which is operable for maintaining the temperature of the trough and any liquid therein at a preselected temperature will be described. Temperature maintenance system 156 includes a trough heater, which in the preferred embodiment takes the form of a length of resistance wire 158, which is formed into an elongate coil and is fixed to the outer surface of trough 64. Coil 158 is held in place by a metallic tape 160. Upon receiving an appropriate signal over bus 26, wire 158 is supplied with a current, thereby heating up and subsequently heating the processing trough. The metallic tape serves to conduct and evenly distribute the applied heat over the outer surface of the trough.

A trough skin temperature sensor 162 is provided to detect the temperature of the outside of the trough. This sensor is operated primarily when the trough does not contain liquid, as when processor 10 is turned on but is between processing cycles, and provides an input to controller 22 which is used to maintain the trough at a processing temperature.

The actual temperature of the solution in the trough is measured by a temperature probe 164 which is located in conduit 136 serving central exhaust drain 132. A signal conditioner 165 is connected between temperature probe 164 and bus 26 to lineralize the temperature signal prior to the signal reaching controller 22. As will be explained later herein, the central drain always contains solution during a processing step and the location of the liquid temperature sensor in this conduit provides an immediate sensory signal to controller 22 of the actual temperature of solution in the trough. Probe 164 and trough temperature sensor 162 are located in areas of trough 64 which generally contain fluid when the processor is processing film.

A trough cooling mechanism is provided, and in the preferred embodiment takes the form of a fan 166 which is activated should the temperature of the trough or the liquid therein rise above a preselected temperature. The fan is operable to move air over the outer wall of the trough, thereby cooling the temperature of the liquid in the trough. In the preferred embodiment, fan 166 is an exhaust fan and draws air from inside cabinet 12 over trough 64. Fan 166 and coil 158 operate alternately such that when coil 158 is turned off, fan 166 is turned on, and vice versa. The fan and coil are operable to change the temperature of a full trough, generally having about 60 ounces of liquid therein, by ½° F. in 60 seconds.

A trough temperature controller is located within controller 22 and is connected to coil 158, trough temperature sensor 162, liquid temperature sensor 164 and fan 166. The trough temperature controller selectively operates the heating and cooling mechanisms to maintain the liquid in the trough at a preselected temperature. The preselected temperature is determined by the specifications for processing the particular photographic material in the processor. The trough temperature controller operates with a mechanism in controller 22 which adjusts processing step times as a function of the actual temperature of the liquids in the trough.

Another feature of the invention is the provision of a trough liquid depth sensor which detects the level of liquid in the trough. The depth sensor includes a port 168 located in conduit 136 serving central exhaust drain 132. A conduit 170 extends from port 168 to controller 22 which contains a pressure transducer (not shown) therein. The liquid depth sensor is used to control the amount of time that a valve in array 80 remains open. As will be discussed later, the level, and hence quantity, of fluid in the trough may be varied by an appropriate input to controller 22. The level of fluid is also determined by the specific gravity of the liquid. Specific gravity values for the solution in each tank are stored in controller 22 to provide a proper solution depth regardless of the specific gravity of the solution. In the preferred embodiment, specific gravity values may be adjusted in 0.02 increments between 1.00 and 1.18.

Controller 22 provides what is referred to herein as an auto-zero calibration of the pressure transducer at the end of each processing step, which terminates with a DUMP step, and prior to beginning a processing cycle. When the trough is empty, the pressure transducer is reset to indicate zero pressure. This calibration is provided to compensate for changes due to temperature fluctuation on the pressure transducer.

The liquid depth sensor input also controls the entry of wash water into trough 64 in certain wash cycles. For any given wash cycle, an appropriate signal is transmitted over controller bus 26 to a wash water solenoid valve 172. Valve 172, when opened, allows temperature controlled water from a temperature controlled water source 174 to enter liquid-entry manifold 62 from where it flows into trough 64.

Water source 174 is connected to a wash water conduit 176 through a needle valve 178, which is operable to control the flow rate of water into the processor. Because the water temperature is critical during the processing cycle, the temperature controlled water must remain flowing in order to provide water of the desired temperature as close as possible to the liquid-entry manifold. To accomplish this, conduit 176 is connected to an outflow conduit 180 which has a bypass flow restrictor 182 located therein. Water going through flow restrictor 182 eventually goes to drain 152. In the preferred embodiment, bypass flow restrictor 182 is generally set at ¼ gallon/minute.

A trough cover 184 is provided to provide a light-tight seal over the top of trough 64. This allows operation of processor 10 under ambient light conditions once the film has been loaded into container 86 and the container is placed in trough 64.

In some instances, it may be desired or necessary to introduce a processing solution into trough 64 which is not contained in any of the storage tanks. Such situations may arise when it is desired to use a developer that has a short shelf life or unique processing characteristics. Controller 22 is constructed to accept a manual trough filling step.

In order to manually fill trough 64 in ambient light conditions, a day-light loading trough lid 186, depicted in FIGS. 4 and 5, is provided. Trough lid, or cover, 186 is constructed to, again, provide a light tight seal over trough 64. However, a solution receiving port 188 is provided at the center of lid 186 for introducing processing solutions into the trough. Port 188 includes a first light baffle 190, a second light baffle 192 and a spray shield 194 located therein. A port lid 196 is provided to cover the port when it is not required to be open, as would be the case during the vast majority of the processing cycle. Like liquid-entry port 106, port 188 is located at the center of trough 64 to provide quick, even dispersion of liquid into the trough.

Figure 8:
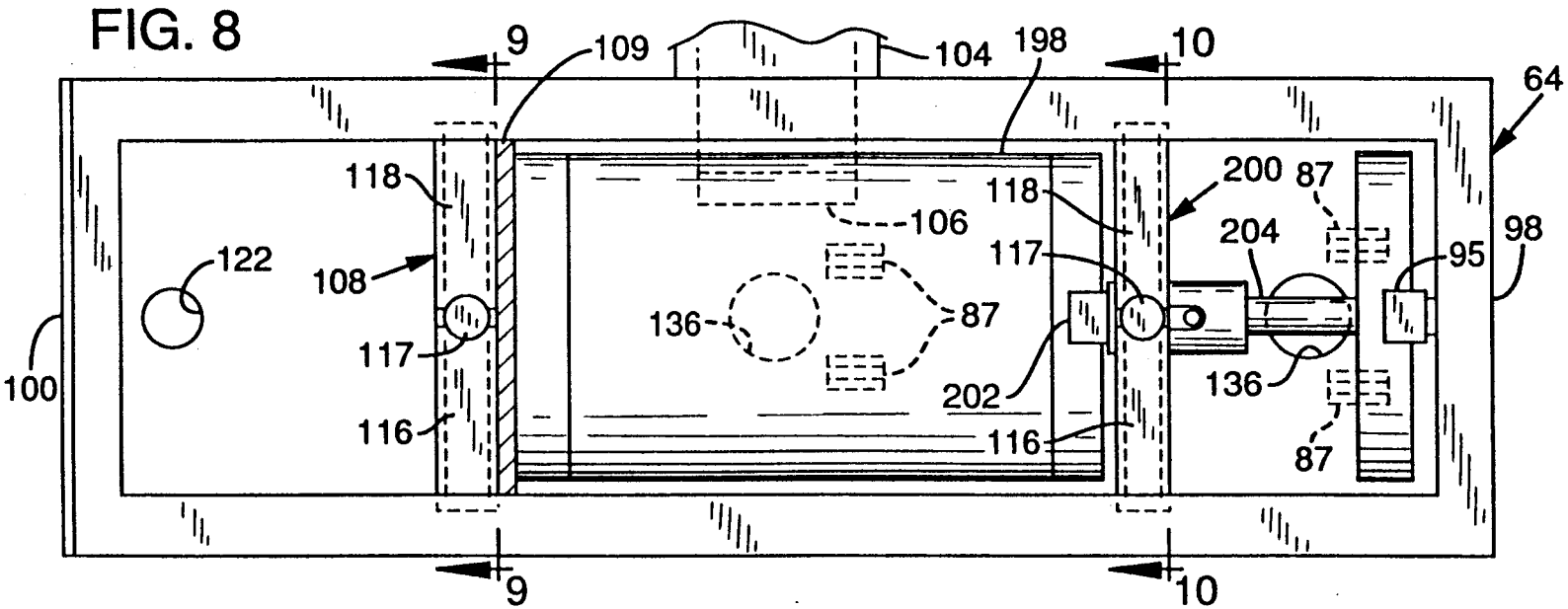
FIG. 8 is a top plan view of the processing trough of FIG. 7, shown in a modified configuration.
Figure 10:
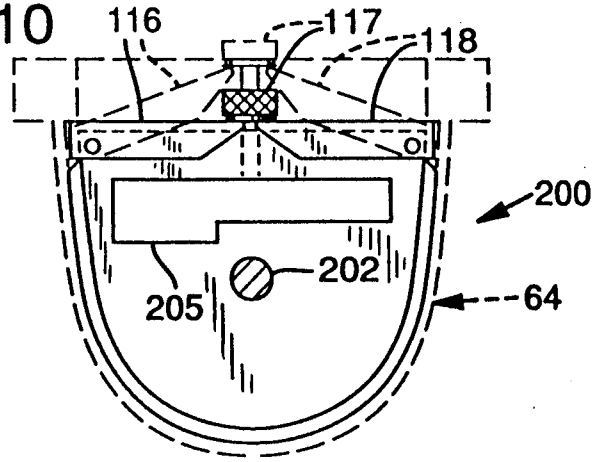
FIG. 10 is a side elevation of a secondary trough dam of the invention which is equipped with a container clutch mechanism.

Processor 10 is provided with a modified means for maintaining the photographic material substantially in the central portion of the trough. Referring now to FIG. 8, a second container 198 is depicted. Container 198 is shorter than container 86 and may be constructed to hold 4 or 5 rolls of 35 mm film. Container 86, on the other hand, is constructed to hold, in the preferred embodiment, up to eleven rolls of 35 mm film. In order to maintain the uniform density processing with a lesser number of rolls, and additionally, to conserve the amount of processing solutions which are to be used to process the lesser amount of film, a secondary trough dam 200, shown in front elevation in FIG. 10, is used adjacent the one end of the trough.

The secondary trough dam 200 is constructed similarly to trough dam 108 and includes another container-engaging clutch mechanism 202 carried thereon. Drive bar 202 is constructed identically to drive bar 94 and is positionable along with secondary trough dam 200 at any position along the length of trough 64. A connector 204 extends between the first mentioned clutch and the clutch carried on the secondary trough dam. Trough dams 108 and 200 may be appropriately positioned to provide a reduced length trough which is substantially symmetrically about liquid-entry port 106 such that the processing fluids will enter the trough uniformly about container 198, and thereby provide uniform processing. In this configuration, obviously, exhaust drain 134, located near one end of trough 64 will not actively drain fluid from the trough, unless such fluid has spilled trough overflow port 205 in secondary trough dam 200, however, with the reduced amount of processing fluids which will be used as a result of the reduced length of the trough, it is not necessary to provide the additional drain location at the bottom of the trough. Port 205 has a slightly different configuration than port 120 to maintain a maximum fluid level in trough 64, which is slightly less than that used with the full-length trough.

The main thrust of the construction of trough 64 is to maintain as short a distance as possible between liquid-entry port 106 and all of the film being processed. When such distance is minimized, the film is wetted evenly and sensitometric deviations are minimized as between rolls or sheets of film being simultaneously processed. If trough 64 is constructed to slope towards one end thereof, the secondary trough dam will be located immediately down-slope of liquid-entry port 106 and exhaust drain 132. If trough 64 is constructed to slope with a dihedral shape towards exhaust drain 132, the primary and secondary trough dams may be positioned generally symmetrically about liquid-entry port 106.

PROCESSOR OPERATION

Before operating processor 10, it is connected to a 110 volt AC power supply, a nitrogen source, and tempered water and pressure regulated water supplies. When the processor is connected to a power source, the heaters in the solution storage tanks and the charger for back-up battery operate continuously. To begin a processing cycle, the operator turns the processor on with power switch 206 on control panel 16. In the event of a power failure, backup battery 25 provides power to all circuits except the storage tank and trough heaters. There is sufficient power stored in the backup battery to complete any normal processing cycle, once the cycle has begun.

A display 208 is provided to indicated processor status to the operator. In the preferred embodiment, display 208 is a four line by 20 character LCD display. In addition to various messages and programming information, the display also provides a graphic indication of set and actual trough liquid level. Entry keys 210, 212 allow the operator to adjust the level of solution in the trough up and down, respectively. The appropriate level for processing a given number of rolls or sheets of film in a particular size of container is provided in a chart in the processor operating manual.

Six other keys are provided in the main portion of control panel 16. The first of these is a MODE key 214. This key allows the operator to select a particular mode of operation. Such modes are RUN, DIAGNOSTIC and EDIT. When the processor is in the RUN mode and a process cycle is underway, the MODE key may be used to view times for the various steps in the selected processing cycle while the process is running. At power up, the processor is defaulted to the RUN mode. If the MODE key is depressed during POWER UP, the specific gravity values for each storage tank may be changed, if required.

A START/ENTER key 216 is provided and is operable to start processing when the processor is in the RUN mode and is used as an ENTER key when the processor is in the DIAGNOSTIC or EDIT mode. The START/ENTER key is also operable to silence audible alarm 27 at any time that the alarm sounds.

The four keys remaining on the control panel serve as cursor keys with keys 218, 220 providing UP and DOWN cursor movements, respectively, while keys 222, 224 serve as LEFT and RIGHT, cursor keys, respectively. LEFT cursor 222 also provides a STEP function, which, when a processing cycle is running, forces the processor to evacuate the contents of processing trough 64 and proceed to the next processing step. RIGHT cursor key 24 functions as a HOLD key which forces the processor to hold the current solution in the processing trough until the key is pressed a second time, at which point normal processing resumes.

The final instrumentation on control panel 16 is a storage tank temperature indicator 226. This indicator is coupled directly to heater supply 48 over a line **226*a* and displays the temperature of solution in a selected storage tank. Rotary switches 228, 230 allow the selection of a particular tank temperature to be displayed. Heater supply 48 is also connected to controller bus 26 to provide a status input to controller 22. If the processor is instructed to begin a processing run when the temperatures of the solutions in the tanks are outside of a predetermined range, alarm 27** will be activated. This may be overridden and processing begun with solutions at temperatures outside of accessible ranges, however, the trough heating/cooling mechanism will be activated in a near continuous manner, and the desired uniformity of film density may not be achieved.

To run the processor, the two water supplies must first be turned on. Next, the nitrogen is turned on at its source. The high pressure setting in the preferred embodiment, should have a reading of 60 to 70 p.s.i. while the low pressure setting should have a reading of 2.5 to 3.5 p.s.i. Power switch 206 is then turned on.

Before entering a RUN cycle, the gas-tight caps 42 on the solution storage tanks should be checked to insure that proper pumping of processing solutions will occur. Additionally, the processor should be checked to insure that there are sufficient processing solutions available for the processing cycle and that the water temperatures are properly set.

Depending on the number of rolls to be processed, one or both of the trough dams are positioned. Once the location of the primary trough dam 108 has been determined, spacer 109 is placed over the dam, which will keep the container from contacting the locking mechanism of the dam during operation. If a secondary trough dam is used, the drive hub will separate the container from the dam locking mechanism.

Once the trough is properly configured, the trough fluid level is set with level keys 210, 212. At this point, display 208 will have the following appearance.

RUN PROCESS
SELECT PROCESS
SET DEVELOPER TIME
PREHEAT

The cursor may now be moved to line 2, SELECT PROCESS and ENTER key 216 depressed. The next and subsequent screens will display preset processes and custom processes. The appropriate process may be selected and the screen will return to the original menu. If desired, the trough and its contents may be preheated by moving the cursor to the PREHEAT selection and pressing ENTER. This will allow water from the temperature controlled water supply 174 to enter trough 64 through liquid-entry manifold 62. The water will initially run through overflow ports 120, 205 in trough dams 108, 200 and into overflow drains 121, 126, and then into exhaust manifold 124. Preheat must then be manually deactivated, again pressing the ENTER key, which causes water to be dumped.

The proper container is then selected for the film format and number of rolls to be processed. The film is loaded onto film reels and the reels placed in the container. A drive hub 95 is placed on one end of the container, which will interlock with the container-engaging drive bar. The film container is placed in the processing trough and trough cover 184 is placed over the trough. At this point, the room lights may be turned on. A convenience back light is provides on display 208. The light may be activated pressing key 232.

A representative process is the C-41 process mentioned earlier. This process will be used as an example of processor operation. With the film loaded in the container, and the container in the trough, the cursor is moved to the RUN PROCESS position of the display and the ENTER key depressed.

The standard process cycle for the C-41 process includes the following steps:

A pre-soak in temperature controlled water of 2:00 minutes;
Development of 3:20 in developer at a temperature of 101° F.;
Bleach for 6:30;
Wash (first) for 2:00;
Fix for 6:30;
Wash (second) for 3:20.

As with all photo processing cycles, proper agitation is important to insure that fresh chemical is always in contact with the material being processed. To this end, drive mechanism 88 is operated by controller 22 such that the container is always rotated in a particular (first) direction as fluid enters the processing trough, with such rotation continuing for a preset time after introduction of the fluid. The motor is then directed to alternately change the rotation of the photographic material in opposite directions after preset periods of time. The preset time for motor-rotation alternation is generally 12–15 seconds for rotation in each direction. For most operations, the container is rotated at 30 rpm, although the processor, in the preferred embodiment, may be adjusted to rotate the container at rotations of 6–42 rpm. Alternating rotation directions, and always rotating in the same direction during trough filling and draining produces uniform run-to-run wetting, eases introduction of fluids into container 86, and assures that the volume of liquid will be properly detected. Such rotation continues throughout the processing with the container always being rotated in the first direction as new fluid is introduced into the processing trough.

The operator begins the processing cycle and the pre-soak step begins, delivering temperature controlled water into trough 64. Once the pre-soak cycle is complete, the exhaust drain valves open, allowing the pre-soak water to enter the exhaust manifold, pass through conduit 144, valve 148 and into drain 152. Controller 22 next sends a signal over bus 26 to valve 82, causing developer to be pumped from tank 28 through conduit 60, manifold 62 and into trough 64. Container 86 is rotated in its first direction while the fluid is entering the processing trough. Processing continues with subsequent solutions until the cycle is complete, at which time tone generator 27*a* generates a tone indicating completion of the cycle. Container 86 continues to be rotated until such time as the operator presses the enter key to stop rotation of the container and acknowledge end of the processing cycle.

Processor 10 is constructed to provide chemistry change in the trough in between 5 and 10 seconds for most process steps. In some instances, such as when solution is stored in a large ($\approx$5 gallon) storage tank, it may take up to 25 seconds to fill the trough. A result of the rapid chemistry change is depicted in FIG. 6. FIG. 6*a* represents the density variation of an eleven test strip run of Eastman Kodak® test strips in a prior art processor. The diagonally extending line represents film density, beginning at one end of the trough and extending to the other end. The variation represents a 20 point spread as plotted on Eastman Kodak record form Y-55. FIG. 6*b* depicts a similar test run in the processor of the invention. The variations between test strips is $<5$ points, and generally runs 3–4 points.

During the processing cycle, the level of fluid in the processing trough is sensed by the pressure transducer connected to conduit 170. This controls the amount of time which the valves in array 80 remain open, or how much time valve 172 remains open during the entry of water into the trough. The use of uniform liquid amounts further enhances the quality control features of the processor. Simultaneously, trough temperature maintenance system 156 is operating to maintain the temperature of solution in the trough to within $\pm$0.25° F. This may be accomplished by alternate heating and cooling of the trough as is required. However, in the event that the temperature is not controlled with the desired precision, controller 22 may adjust the time of any adjustable step, such as a developer step, of the processing cycle to obtain the desired film density. For instance, if the average temperature of developer in the trough is above the preselected temperature, and outside of the acceptable temperature deviation range, the amount of time which the developer remains in the trough may be adjusted downward, resulting in a shorter development step during the processing cycle. This feature will be explained in more detail later herein.

Processor 10 provides three distinct types of wash cycles to stop various chemical reactions and to purge the film of processing solutions. The first wash cycle is a continuous cycle wherein valve 172 is opened, exhaust valves 138 are closed, and the wash water is circulated through manifold 62, into trough 64, and overflows through trough dam ports 120, and 205 if the secondary trough dam is in place, and leaves trough 64 through overflow drains 121 and 126. The continuous wash cycle is used in normal processor operations.

A second type of wash cycle is referred to as a quick, or pulsed, wash. In this cycle, the water is treated similarly to processing solutions in that valve 172 is opened long enough for the trough to fill, as detected by the pressure transducer. Valve 172 is closed and the exhaust valves are immediately opened. The quick wash cycle is used to quickly stop a chemical reaction and may be used serially.

The third type of wash cycle is referred to as a water saver cycle, and is also a pulsed cycle. It operates similarly to the quick wash cycle except the water is held in the trough for a predetermined amount of time. The water saver cycle may be used following a quick wash cycle to conserve water and limit effluent from the processor. If necessary, water for the quick wash and water saver cycles may be stored in solution storage tanks. This capability is useful if the processor is used in waterscarce areas, or in field conditions. Because a chemical reaction, particularly that caused by developer solutions, does not immediately stop if water is merely introduced into the trough and retained, a water saver cycle should be preceded by a quick wash cycle. For particularly fast processing cycles, the continuous wash cycle may be replaced with several, serial quick wash cycles.

In the event that the number of rolls of film that to be processed do not require a large container, the primary and secondary trough dams are positioned, with the appropriate length connector extending between the primary clutch and the clutch on the secondary dam. Again, film is loaded into the container, placed in the trough and the processing started. In this manner, it is possible to process a variety of film types without having to handle processing solutions. Additionally, the temperature and time are very closely controlled in the processor, resulting in the uniform film density.

CONTROLLER OPERATION

Figure 11:
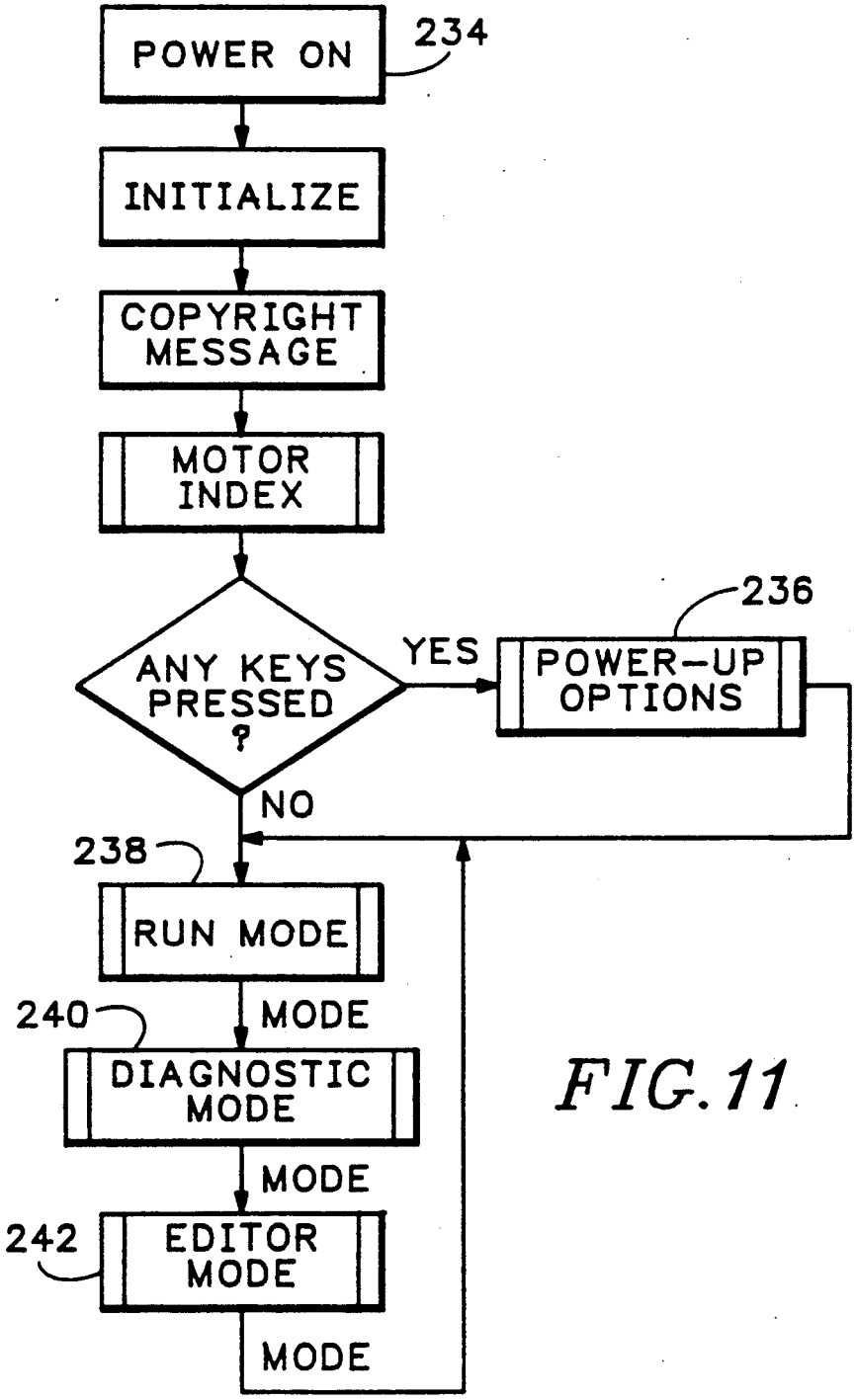
FIGS. 11–19B are block diagrams of portions of the control system of the invention.

Referring now to FIG. 11, a block diagram illustrating the operation of controller 22 is depicted. Further details of controller 22 are provided in FIGS. 12–19.

As previously noted, display 208 (FIG. 1) is a 4 line by 20 character alphanumeric LCD display, used in the preferred embodiment. Because of the selection of the particular display, menu selections tend to be collected in four item groups. The use of a larger or smaller display may result in changing of the relationship between the controller steps without effecting the operation of processor 10.

Referring now to FIG. 11, the initial step in operating processor 10 is, assuming all fluid connections are in place, turning the processor on with power switch 206. This initiates the POWER ON subroutine 234. The controller goes through an initialization routine and, provided that the operator has not selected any of the power up options, block 236, enters the RUN MODE, block 238. The operator, may of course, select any number of power-up options to check processor operations and settings, or may enter a DIAGNOSTIC MODE, block 240 to check the status of various system components, or enter an EDITOR MODE, block 242 to enter new process steps, or change process times and/or temperature.

As previously noted, controller 22 is constructed to automatically operate processor 10. To this end, a number of feedback loops are constructed between controller 22, bus 26 and the various components of the processor to allow controller 22 to operate the various components and to monitor the condition of the components. Such construction is considered to be within the knowledge of those skilled in the art. There are, however, control functions which are unique to the processor of the invention, which will now be described.

In order to maintain a uniform density in processed material, it is imperative that the temperature of the processing solutions and the time which the photographic material spends in any given solution is very closely controlled. Additionally, it is well known that, particularly in the case of developers, a temperature deviation that is above the established temperature will, produce a more dense negative, development time as being standardized. Conversely, a lower temperature will produce a less dense negative. This characteristic of photographic material is useable to promote highly uniform negatives or transparencies by providing compensation of time for temperature variations through the use of controller 22.

Figure 12:
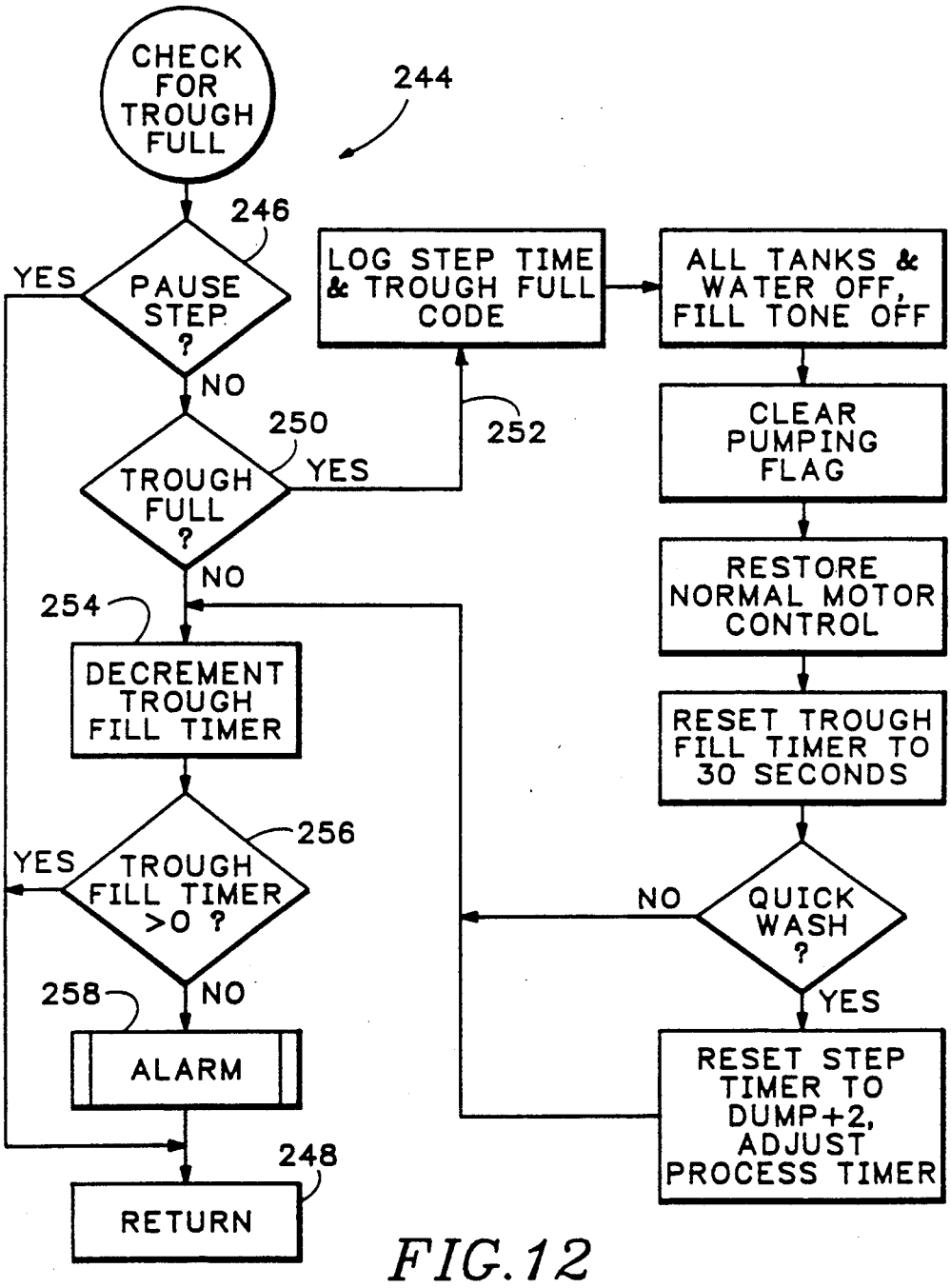
Figure 13:
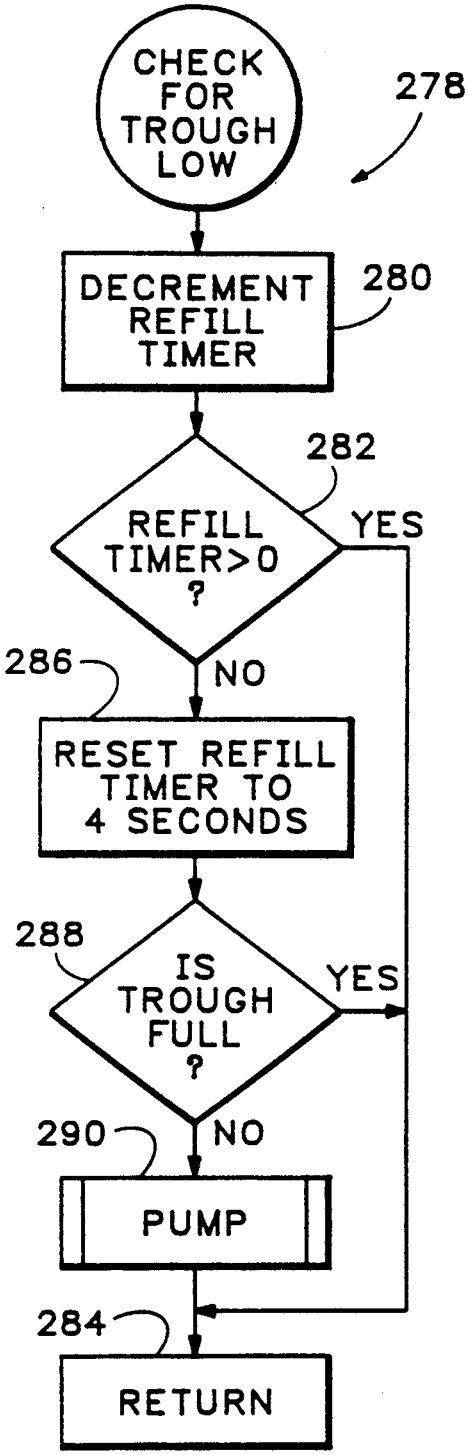

Referring now to FIGS. 12–18, a portion of the RUN subroutine is depicted. FIGS. 12 and 13 represent two subroutines 244, 246, respectively, which represent checks by controller 22 to determine if trough 64 is full, or if the solution level is low. Referring now to FIG. 12, CHECK FOR TROUGH FULL subroutine 244 is depicted in detail. After the subroutine is called, the controller determines whether the cycle is in a PAUSE step or not, block 246. If the cycle is in a PAUSE step, the subroutine returns, block 248, to the main RUN program. If the cycle is not in a PAUSE step, controller 22 determines whether the trough is full or not, block 250. As previously noted, the level of fluid in the trough is determined by a pressure transducer which is connected through a conduit 170 to a pressure port 168, which is located in a conduit leading away from the bottom of the trough. The appropriate level of fluid is determined by the operator during processor set up. If the trough is full, controller 22 goes through the steps indicated in loop 252 which essentially resets controller 22 to be ready for the next filling operation.

If the trough is not full, the trough fill timer is decremented, block 254. At such time as the trough fill timer exceeds zero, the subroutine is exited and controller 22 returns to the main program block 256. If the trough timer does not exceed zero, an alarm is triggered, block 258.

Figure 17:
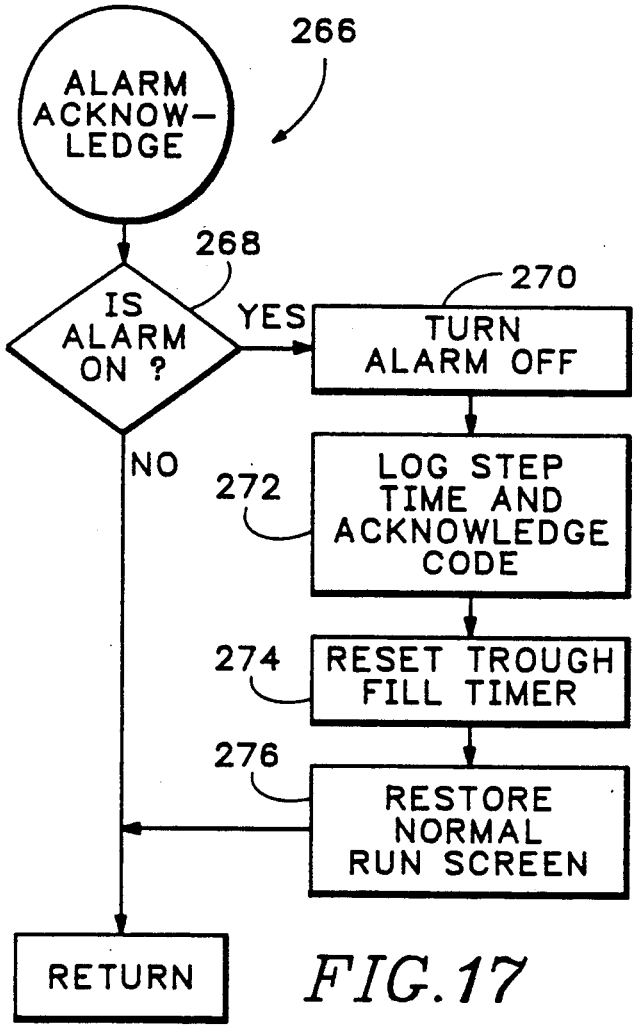
Figure 18:
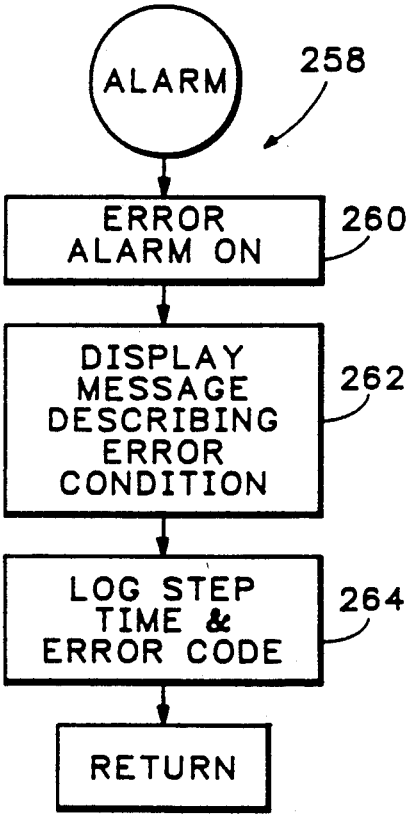
Figure 19A:
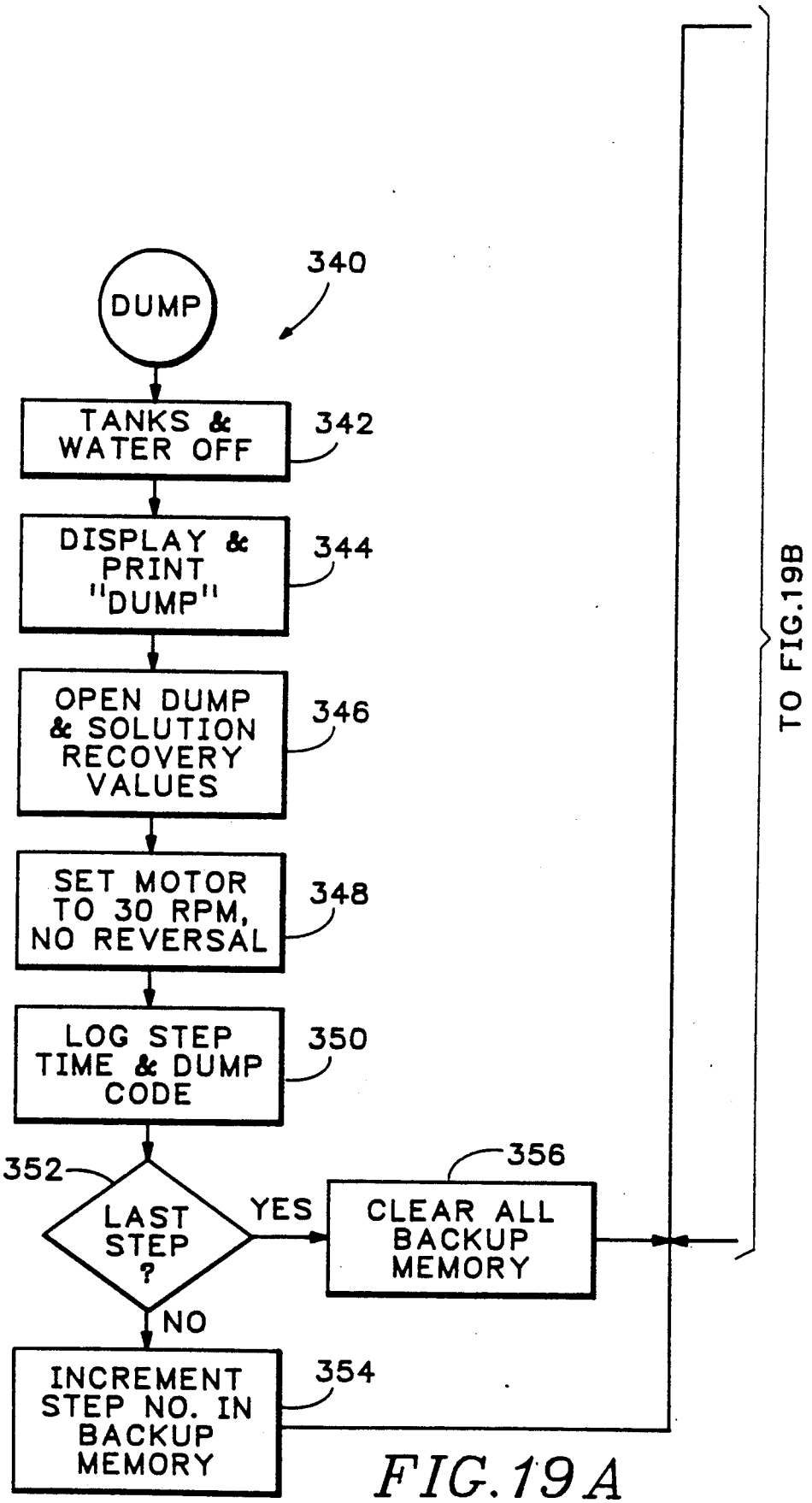
Figure 19B:
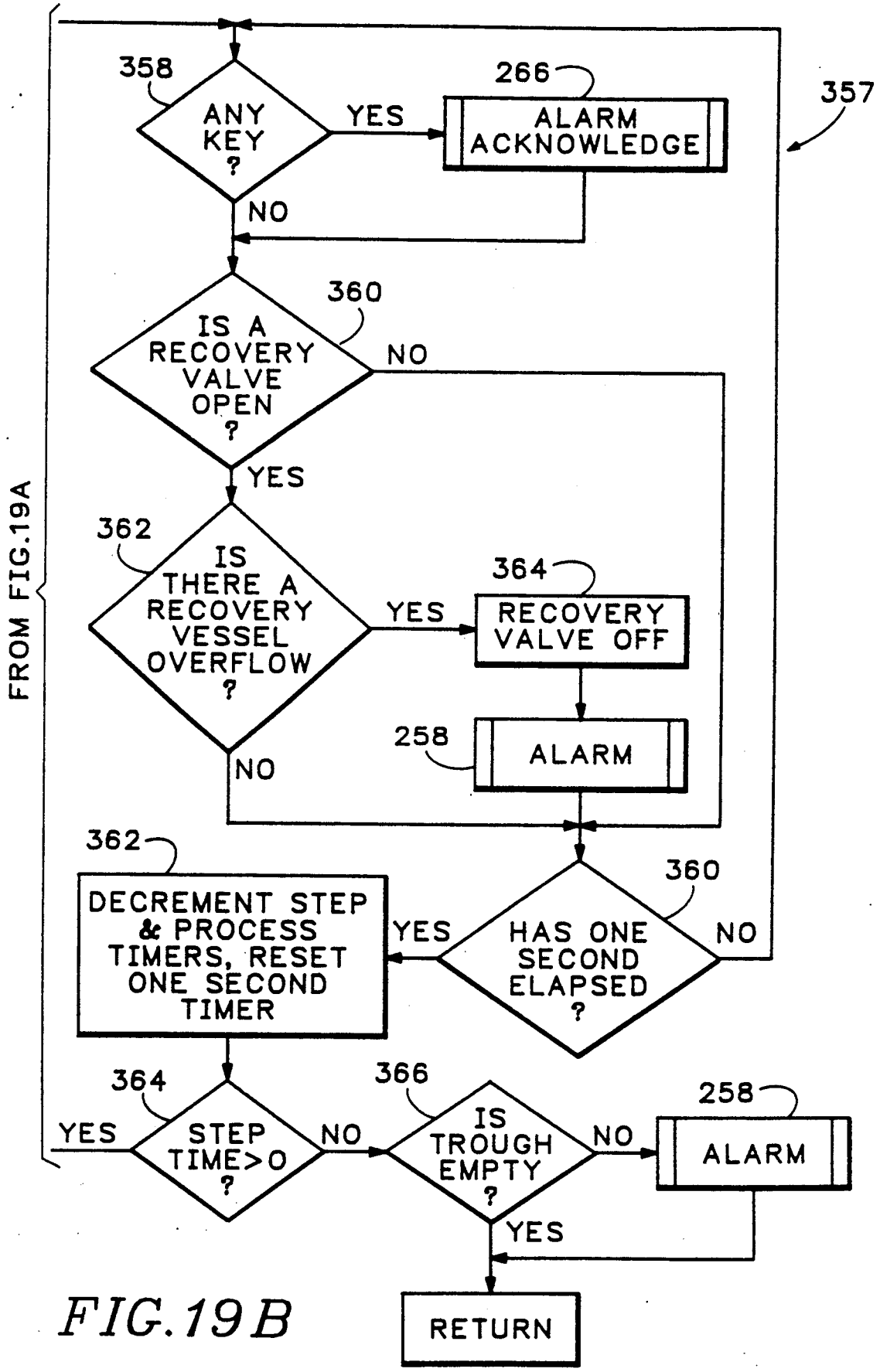

Turning momentarily to FIG. 18, the steps in the ALARM subroutine are depicted. The steps involved turning alarm 27 on, block 260, displaying a message on LCD 208 describing the error condition, block 262, and storing the step time and error code in memory, block 264. An ALARM ACKNOWLEDGE subroutine 266 is depicted in FIG. 17 and includes, initially, a query as to whether or not the alarm is on, block 268, and, if so, turning the alarm off, block 270, which is accomplished by depressing START/ENTER key 216 on control panel 16. The step time and acknowledgement code is stored in memory, block 272 and the trough fill timer is reset, block 274. Display 208 is restored to normal, block 276, and the subroutine is exited.

Returning now to FIG. 12, once all of the steps have been completed, the TROUGH FULL subroutine is exited and the main RUN program is continued. A CHECK FOR TROUGH LOW subroutine 278 is run to determine if the level of fluid in the trough below that which is required for the processing cycle. The first step in the subroutine is that of decrementing of refill timer, block 280. If the refill timer is greater than zero, block 282, the subroutine returns block 284, to the main RUN routine. If the refill timer is not greater than zero, it is reset to a time of four seconds, block 286. If the pressure transducer still indicates that the trough is not full, block 288, a PUMP subroutine 290 is started.

Figure 16:
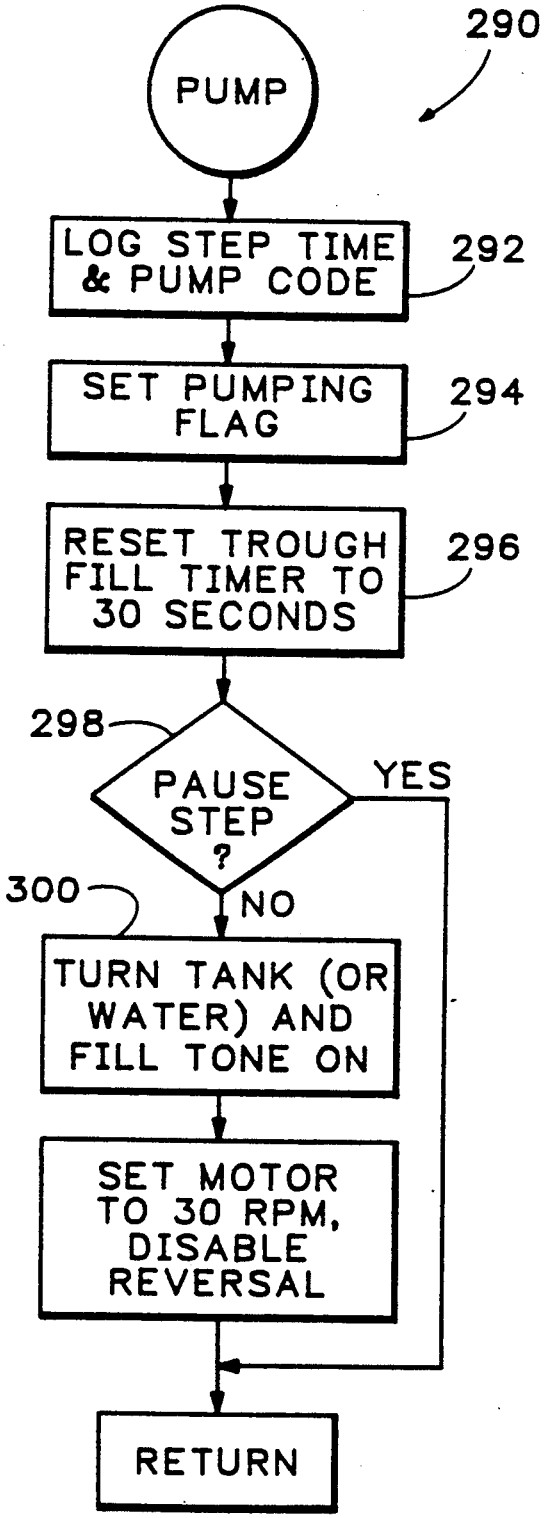

PUMP subroutine 290 is depicted in FIG. 16 and initially includes a procedure of storing the step time and pump code, the code that activates a particular valve in array 80, in memory, block 292. A pump flag is set, block 294 and the trough fill timer is reset to thirty seconds, block 296. Controller 22 next determines whether it is in a PAUSE step, block 298, and if so, returns to the main RUN subroutine. A PAUSE step is provided to enable more complete draining of liquids from the film or to provide for air incubation, which is used instead of a pre-soak for some types of film. During a PAUSE step, motor 90 continues to operate, but no liquids enter trough 64. If the cycle is not at a PAUSE step, a valve in array 80, or wash water solenoid valve 172, is activated and a fill tone is sounded through tone generator 27*a* block 300. Controller 22 continues through the CHECK FOR TROUGH FULL 244 subroutine and CHECK FOR TROUGH LOW 278 subroutine until such time as it determines that the trough has the proper level of liquid therein.

As previously noted, a main feature of the processor of the invention is the provision of a trough temperature controller and a time/temperature compensation mechanism. A TROUGH TEMPERATURE subroutine 302 is provided to maintain the solution temperature in the trough within, in the preferred embodiment, ±0.25° F. of a preselected temperature value. The first step in the subroutine is to decrement the trough temperature timer, block 304. If the timer is greater than zero, block 306, the timer is reset to a value of five seconds, block 308. The temperature is then measured by probe 164 and the temperature, along with the prior reading is averaged, block 310. The current temperature is displayed on LCD 208, block 312. If the average temperature is greater than the preselected temperature, block 314, trough heater 158 is shut off and fan 166 is turned on, block 316. If the temperature is not greater than the preselected temperature, the trough heater is turned on and fan 166 is turned off, block 318.

Once the heater is turned either on or off, or if the timer is greater than zero, the subroutine determines whether the step within the processing cycle is an adjustable step, block 320, meaning, can the time for the processing cycle step be adjusted. If the step is not an adjustable step, the subroutine is exited and the controller returns to the RUN subroutine. If the step is adjustable, the controller next determines whether eighty percent of the step time has elapsed, block 322. If eighty percent of the step time has not elapsed, the controller returns to the main RUN subroutine.

Figure 15:
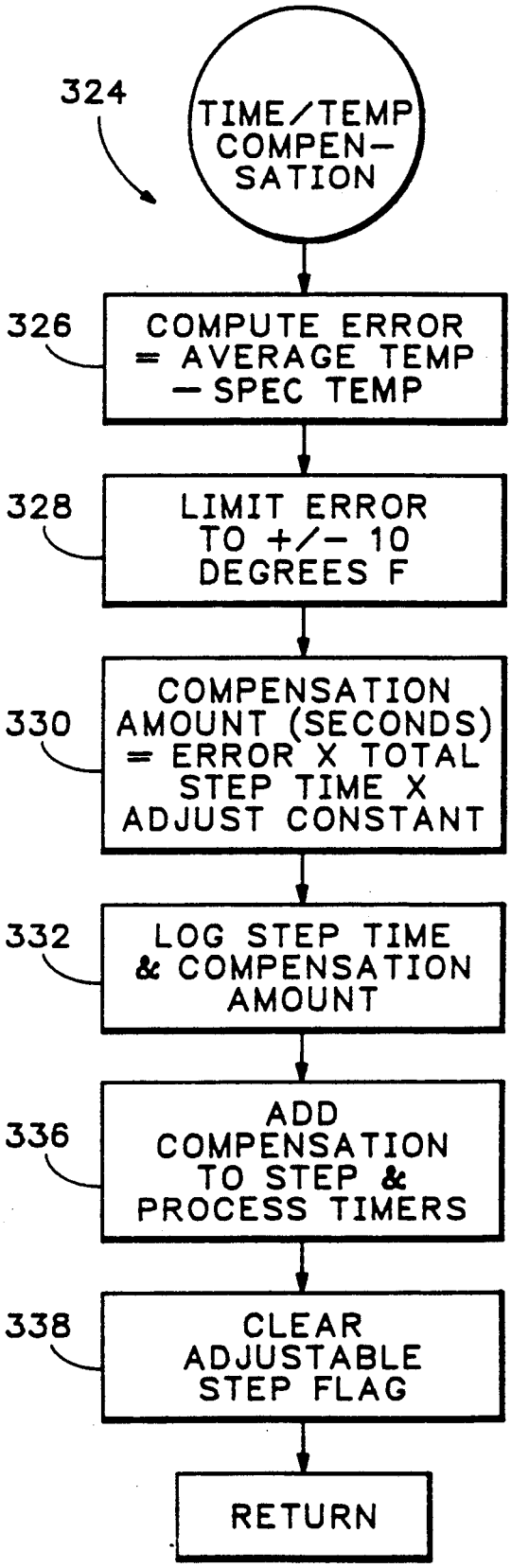
Figure 14:
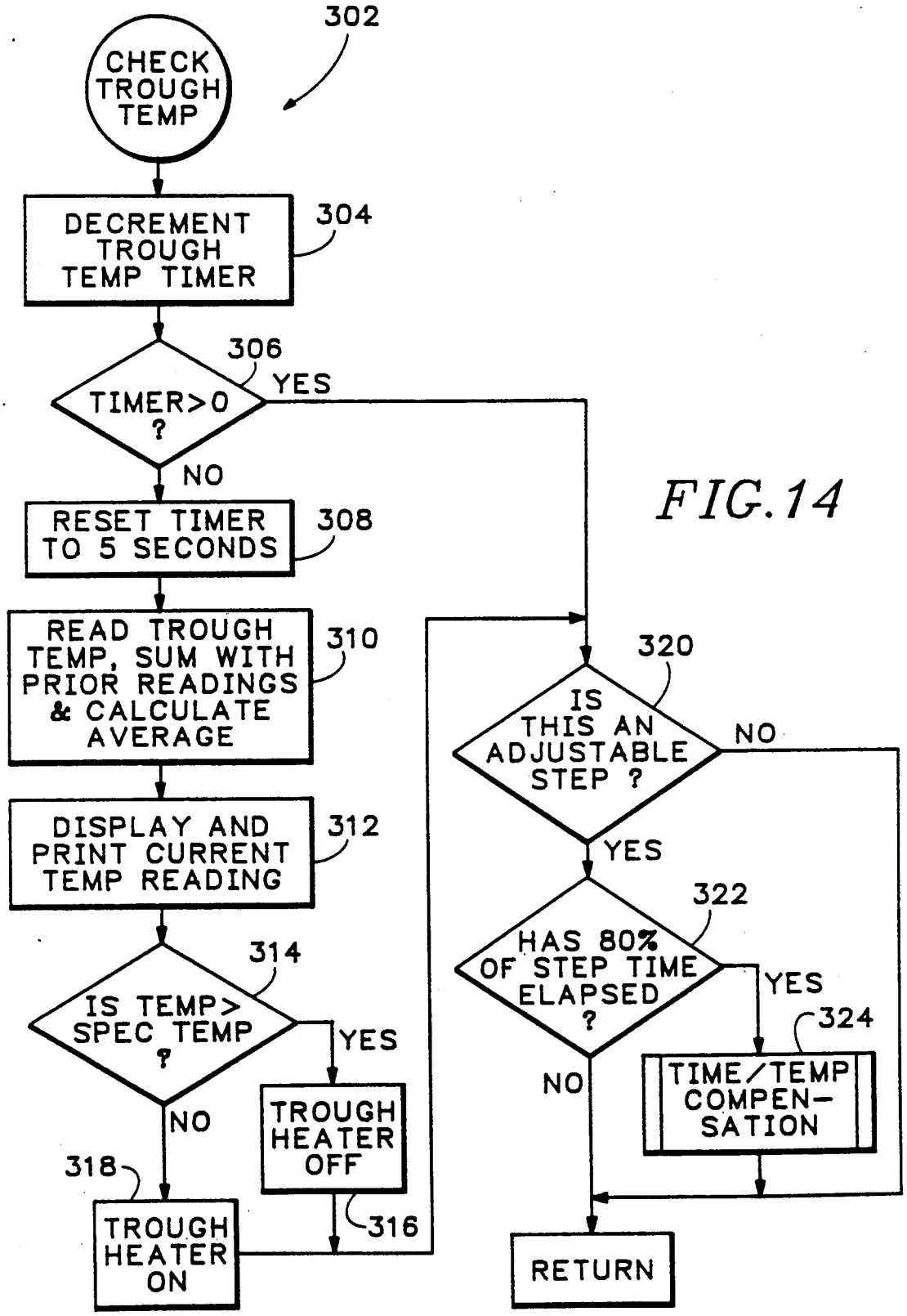

If eighty percent of the step time has elapsed, TIME/TEMPERATURE COMPENSATION subroutine 324 is begun, which is depicted in FIG. 15. The first step in the TIME/TEMPERATURE COMPENSATION subroutine requires controller 22 to determine the error by subtracting the preselected temperature from the average temperature determined in block 310, block 326. The error is then limited to plus or minus 10° F., block 328. This step is provided in order to prevent an overload on the trough temperature maintenance system 156, which may occur in the event that a fluid, such as cold tap water, which may have a winter-time temperature in the forties, is accidentally introduced into the trough during a color film processing cycle with requires a temperature of 101° F. A compensation amount, in seconds, is determined from the product of the error determined in blocks 326, 328, the total step time and an adjustment constant, block 330. The adjustment constant is user settable for each cycle step in a process. The step time and compensation amount are stored in controller memory, block 332. The compensation amount is added to the step and process timers, block 336 in order to adjust the time that the solution will remain in the trough. The compensation may, of course, have a positive or negative sign. The adjustable step flag is cleared, block 338 and the subroutine is exited back to the CHECK TROUGH TEMPERATURE subroutine 302.

Once a particular processing step is completed, the liquid is dumped from trough 64 as controller 22 executes DUMP subroutine 340. The first step of the subroutine is to close any valves in array 80 and wash water solenoid valve 172, block 342. Display 208 has the word "dump" displayed thereon, block 344 while valves 138 are simultaneously open, along with either valve 148, to drain the solution out of manifold 124, or valve 150, allowing the solution to enter recovery system 154, block 346. During the DUMP subroutine, motor 90 is set to operate as 30 rpm and turns in one direction only, without reversing, block 348. The step time and dump code are stored in memory in controller 22, block 350. The controller then determines whether the cycle is at the last step therein, block 352, and if not, increments the step number in memory, block 354. If the cycle is at the last step, the backup memory is cleared, block 356.

The controller then determines whether any key is pressed, block 358, and if so, moves to the ALARM ACKNOWLEDGE subroutine, block 266, as depicted in FIG. 17. Once the ALARM ACKNOWLEDGE subroutine is run, or if no key is pressed, the controller determines whether a recovery valve is open, block 360. The recovery valves sensed at this part of the subroutine include valve 150 and any valves which are part of the recovery system, directing used solution to any of a number of recovery vessels. If a recovery valve is open, the system determines, from sensors in the recovery system, whether there is an overflow in a recovery vessel, block 362. If the vessel is at an overflow state, the recovery valve is turned off, block 364, and alarm 27 activated through subroutine 258. The subroutine next determines whether one second has elapsed, block 360, and if not, again looks to see if any key is depressed, block 358. If a second has elapsed, the step and process timers are decremented and a one second timer is reset, block 362. If the step time is greater than zero, block 364, the recovery portion of the subroutine, indicated generally at 357 is repeated. If the step time is not greater than zero, controller 22 determines whether the trough is empty, block 366, and if so, exits the subroutine. If the trough is not empty, the ALARM subroutine, block 258, is again executed to alert the operator.

Thus a photo processor has been disclosed which will automatically process several rolls of film, contains storage facilities for handling several different processes, and provide uniform photographic density of the photographic materials processed therein. The processor is capable of automatically adjusting process step times as a function of the temperature of a processing solution.

Although a preferred embodiment of the invention, and several modifications thereto, have been disclosed, it should be appreciated that further modifications may be made without departing from the scope of the invention as defined in the appended claims.

What we claim is:

1. A photo processor for processing sensitized photographic materials in various liquid chemical solutions in a processing procedure, for use with a water source and a disposal system, comprising:

plural solution storage tanks;

an elongate processing trough;

a liquid-entry manifold located intermediate the ends of said trough, adjacent the center thereof, for introducing processing solutions and water (liquids) into said trough;

means for maintaining the photographic material substantially in the central portion of said trough adjacent said liquid-entry manifold;

plural, substantially simultaneously acting exhaust drains for exhausting a liquid from said trough; and a liquid delivery system for delivering the solutions from said storage tanks to said trough and for delivering wash water into said trough.

2. The photo processor of claim 1 wherein said means for maintaining includes a container for holding the photographic material, and at least one trough dam which is positionable and fixable across the trough to restrict the location of liquid-entry manifold to the region about said container, said dam having a sealing gasket about the edge thereof which is received in said trough in a sealing relationship therewith, and a locking mechanism for holding the dam in a predetermined location.

3. The photo processor of claim 2 wherein said trough includes an overflow system having an outlet at one end thereof for allowing draining of liquid from said trough above a predetermined level when said liquid exceeds said predetermined level and wherein said dam is constructed and arranged to allow passage of liquid when such liquid level exceeds said predetermined level.

4. The photo processor of claim 1 which includes a drive mechanism for rotating the photographic material in said trough, said drive mechanism being constructed and arranged to rotate the photographic material in a first direction during introduction of a liquid and for a preset time period thereafter, and then to alternately change the rotation of the photographic material in opposite directions after preset periods of time.

5. The photo processor of claim 4 wherein said drive mechanism includes a container-engaging clutch, a clutch position sensor for detecting the position of said clutch, and means for stopping said drive mechanism at the end of a processing procedure with said clutch in a container-removing position.

6. The photo processor of claim 1 which further includes a trough-temperature maintenance system for maintaining the temperature of said trough and any liquid therein at a preselected temperature.

7. The photo processor of claim 6 wherein said trough temperature maintenance system includes a trough heater fixed to the outer surface of said trough, a trough cooling mechanism, a trough temperature sensor, a liquid temperature sensor, and a trough temperature controller for selectively operating said trough heater and said trough cooling mechanism to maintain a liquid in said trough at said preselected temperature.

8. The photo processor of claim 1 which further includes a trough liquid depth sensor including a pressure transducer for detecting the level of a liquid in said trough.

9. The photo processor of claim 8 wherein said depth sensor is located in one of said exhaust drains.

10. The photo processor of claim 1 wherein said trough is oriented substantially horizontally and wherein the bottom of the trough is longitudinally sloped toward one of said exhaust drains.

11. The photo processor of claim 10 wherein one exhaust drain is located adjacent one end of said trough and the other exhaust drain is located in the center of said trough, adjacent said liquid-entry manifold.

12. The photo processor of claim 1 wherein said exhaust drains each include a remotely-operable valve therein, and which further includes an exhaust manifold with which said exhaust drains communicate upon opening of said valves.

13. The photo processor of claim 12 which further includes a solution recovery system for recovery select photographic processing solutions and wherein said exhaust manifold is constructed and arranged to selectively dispense used solutions to said solution recovery system or to the disposal system for discarding solutions and wash water.

14. The photo processor of claim 1 wherein each of said storage tanks includes a cell having a gas-tight wall thereabout, a draw tube having a draw orifice located adjacent the base of the cell and extending through said wall, and a gas inlet port located in said wall for allowing the entry of pressurized gas into said tank, said pressurized gas being operable to force the processing solution in said tank through said draw tube.

15. The photo processor of claim 14 wherein a conduit extends between each solution storage tank draw tube and said liquid-entry manifold for conducting processing solution from said storage tank to said liquid-entry manifold.

16. The photo processor of claim 1 wherein said storage tanks each include a temperature control system for maintaining the temperature of solution in each tank at a preset temperature.

17. The photo processor of claim 16 wherein said storage tank temperature control system includes a linear temperature probe in each tank for measuring the temperature of the solution in the tank.

18. The photo processor of claim 16 wherein said storage tank temperature control system includes a heater probe in each tank for heating the solution therein.

19. The photo processor of claim 16 wherein said storage tank temperature control system includes a heat exchanger in each tank for changing the temperature of the solution in said tank, said heat exchanger being connected to a water supply of appropriate temperature for accomplishing such temperature changing.

20. The photo processor of claim 1 which includes a water delivery system including a temperature-controlled water system having a control valve for controlling entry of temperature controlled wash water into said liquid-entry manifold, said temperature-controlled water system having a bypass-flow regulator to maintained temperature controlled wash water adjacent said control valve while the processor is in operation.

21. A photo processor for processing sensitized photographic materials in various liquid chemical solutions in a processing procedure, for use with a water source and a disposal system, comprising:

plural solution storage tanks;

an elongate processing trough having a liquid-entry port located about the middle thereof;

a liquid-entry manifold connected to said liquid-entry port for introducing processing solutions and water (liquids) into said trough;

means for maintaining the photographic material substantially in the central portion of said trough adjacent said liquid-entry port;

plural, substantially simultaneously acting exhaust drains for exhausting a liquid from said trough;

a liquid delivery system for delivering the solutions from said storage tanks to said trough and for delivering wash water into said trough; and a control system for coordinating processor operation.

22. The photo processor of claim 21 which includes a container for holding the photographic material, wherein said trough is substantially horizontally oriented and which further includes a drive mechanism located at one end of said trough for rotating said container in said trough, and wherein a first trough dam, which is positionable and fixable across the trough adjacent the other end thereof to restrict the location of liquid which is received through said liquid-entry port to the region about said container, said dam having a sealing gasket about the edge thereof which is received in said trough in a sealing relationship therewith, and a locking mechanism for holding the dam in a predetermined location.

23. The photo processor of claim 22 wherein said drive mechanism includes a reversing mechanism and wherein said control system is constructed and arranged to cause said drive mechanism to rotate said container in a first direction during introduction of a liquid into said trough, and for a preset time period thereafter, and then to alternately change the direction of rotation of the container after preset periods of time.

24. The photo processor of claim 23 wherein said drive mechanism includes a container-engaging clutch, a clutch position sensor for detecting the position of said clutch, and means for stopping said drive mechanism at the end of a processing procedure with said clutch in a container-removing position.

25. The photo processor of claim 24 which further includes a second trough dam having another container-engaging clutch carried thereon and which further includes a connector for connecting said other container-engaging clutch to said first-mentioned container-engaging clutch, said second trough dam and said first trough dam being positionable in said trough about said liquid-entry port to form a reduced length trough.

26. The photo processor of claim 21 which further includes a trough-temperature maintenance system for maintaining the temperature of said trough and any liquid therein at a preselected temperature, wherein said trough includes a trough heater and a trough temperature sensor fixed to the outer surface of said trough, a trough cooling mechanism, a liquid temperature sensor located in said trough for sensing the temperature of a solution in the trough, and wherein said control system includes a trough temperature controller for selectively operating said trough heater and said trough cooling mechanism to maintain a liquid in said trough at said preselected temperature.

27. The photo processor of claim 26 wherein said control system includes means for determining, for a given process cycle step, a processing cycle step time and a processing cycle temperature for a particular type of photographic material, and wherein said control system further includes means for adjusting said processing cycle step time during selected processing steps as a function of measured processing solution temperature.

28. The photo processor of claim 21 wherein each of said storage tanks includes a cell having a gas-tight wall thereabout, a draw tube having a draw orifice located adjacent the base of a cell and extending through said wall, a conduit extending between said draw tube and said liquid-entry manifold for conducting processing solutions from said tanks to said liquid-entry manifold, and which further includes a gas supply, a gas valve for each storage tank, and a gas inlet port located in said wall for allowing the entry of pressurized gas into said tank, said pressurized gas being operable to force the processing solution in said tank to said liquid-entry manifold.

29. The photo processor of claim 21 wherein said exhaust drains each include an exhaust valve therein which is operated by said control system, and which further includes an exhaust manifold with which said exhaust drains communicate upon opening of said exhaust valves.

30. The photo processor of claim 29 which further includes a liquid depth sensor including a pressure transducer for detecting the level of a liquid in said trough, wherein said depth sensor is located in one of said exhaust drains, and wherein said control system is operable to open said gas valve thereby allowing liquid to be pumped into said trough to a predetermined level.

31. The photo processor of claim 30 wherein said control system includes means for adjusting the level of a liquid in said trough as a function of the specific gravity of the liquid.

32. The photo processor of claim 30 wherein said control system includes means for calibrating said pressure transducer between processing cycle steps.

33. The photo processor of claim 21 wherein said controller includes a continuous wash cycle selector for providing a continuous wash cycle and a pulsed wash cycle selector for providing a pulsed wash cycle.

34. The photo processor of claim 21 wherein said storage tanks each include a temperature control system for maintaining the temperature of solution in each tank at a preset temperature.

35. The photo processor of claim 34 wherein each storage tank includes a linear temperature sensor located therein for measuring the temperature of the solution in the tank, a heater for heating the solution therein, and wherein said temperature sensor and said heater are located on the same probe structure which is secured to the tank through a wall thereof.

36. The photo processor of claim 35 wherein each tank includes a heat exchanger for changing the temperature of the solution in said tank, said heat exchanger being connected to a water source of appropriate temperature for accomplishing such temperature changing.

37. The photo processor of claim 36 wherein said storage tank temperature system includes a control mechanism for determining the temperature of solution in each of said tanks and for controlling said heater and said heat exchanger to maintain the temperature of the solutions at the preset temperature.

38. The photo processor of claim 21 which includes a water delivery system connected to the water source including a temperature-controlled water system having a control valve for controlling entry of temperature controlled wash water into said liquid-entry manifold, said temperature-controlled water system having a bypass-flow regulator to maintained temperature controlled wash water adjacent said control valve while the processor is in operation.

39. The photo processor of claim 21 which includes an elongate, manual-fill, light-tight cover for said trough, said manual-fill cover having a fluid entry port located intermediate the ends thereof and an array of baffles located in said port for allowing filling of said trough with liquid from a vessel.

40. In a photo processor for processing sensitized photographic materials in various liquid processing solutions in a processing procedure, connected to a water source and a disposal system, and having solution storage means, a processing trough, a liquid-entry manifold for introducing processing solutions into the trough, exhaust drains for exhausting a liquid from the trough, and a liquid delivery system for delivering the solutions from the storage means to the trough and for delivering wash water into the trough, a control system, including means for storing preset cycle step temperatures and predetermined cycle step times, comprising:

a temperature sensor located in the trough for sensing the actual temperature of liquid in the trough;

means for heating and cooling liquids in the trough; and means for adjusting the cycle step time as a function of the temperature deviation of the processing solution from the cycle step temperature.

41. The control system of claim 40 wherein said means for adjusting is constructed to adjust the step time only in the last about 20% of the step time.

42. The photo processor of claim 41 further includes means for selecting processing solution depth in the trough, which includes a liquid depth sensor port in the trough and a pressure transducer connected thereto and to the control system, and which includes means for providing solution specific gravity compensation for each processing solution to the central system.

* * * * *